US012466609B2

(12) United States Patent
Grumberg

(10) Patent No.: US 12,466,609 B2
(45) Date of Patent: Nov. 11, 2025

(54) MODULAR PALLET SYSTEM

(71) Applicant: Mathieu J. Grumberg, Delmar, NY (US)

(72) Inventor: Mathieu J. Grumberg, Delmar, NY (US)

( * ) Notice: Subject to any disclaimer, the term of this patent is extended or adjusted under 35 U.S.C. 154(b) by 0 days.

(21) Appl. No.: 18/349,152

(22) Filed: Jul. 9, 2023

(65) Prior Publication Data

US 2025/0011034 A1 Jan. 9, 2025

(51) Int. Cl.
*B65D 19/00* (2006.01)

(52) U.S. Cl.
CPC ..... *B65D 19/0095* (2013.01); *B65D 2519/00024* (2013.01); *B65D 2519/00029* (2013.01); *B65D 2519/00034* (2013.01); *B65D 2519/00273* (2013.01); *B65D 2519/00333* (2013.01)

(58) Field of Classification Search
CPC ..... B65D 2519/00547; B65D 2519/00273; B65D 2519/00552; B65D 2519/00333; B65D 19/0095
USPC ..... 108/56.3, 56.1, 53.3
See application file for complete search history.

(56) References Cited

U.S. PATENT DOCUMENTS 2,871,536 A * 2/1959 Childress ..... B65D 63/06 24/23 W
3,112,715 A * 12/1963 Callahan ..... B65D 19/0048 108/52.1
3,120,825 A * 2/1964 Johnson ..... B65D 19/004 108/53.3
3,227,108 A * 1/1966 Johnson ..... B65D 19/0095 108/53.3
3,433,184 A * 3/1969 Addy ..... B65D 19/004 108/55.3
3,701,326 A * 10/1972 Herman ..... B65D 19/0097 108/53.3
3,878,796 A * 4/1975 Morrison ..... B65D 19/0075 108/56.1
4,077,334 A * 3/1978 Svirklys ..... B65D 19/0097 52/579
4,145,974 A * 3/1979 Fleming ..... B65D 19/004 108/57.29
4,145,976 A * 3/1979 Svirklys ..... B65D 19/0095 403/231
5,365,859 A * 11/1994 Schrage ..... B65D 19/0071 108/56.1
5,367,960 A * 11/1994 Schleicher ..... B65D 19/0095 108/57.32
5,458,069 A * 10/1995 Stolzman ..... B29C 66/1122 108/901
5,647,493 A * 7/1997 Sippel ..... B65D 19/0075 211/189

(Continued)

*Primary Examiner* — Jose V Chen
(74) *Attorney, Agent, or Firm* — Amundsen Davis, LLC

(57) ABSTRACT

A Modular Pallet System for storage and transport of goods, assembled using Stringer Assemblies comprising 2 or more elongate members that translate in relation to each other to facilitate location and clamping of wood, composite or metal Deck Boards. Stringer Assemblies are assembled from 2 or more elongate members that translate in relation to each other to facilitate location and clamping of Deck Boards. Deck Boards can be manufactured from wood, composite or metal. Clamping action can be achieved by screw, wedge, cam or other mechanical means.

15 Claims, 37 Drawing Sheets

(56) References Cited

U.S. PATENT DOCUMENTS

| | | | | |
|---|---|---|---|---|
| 5,809,902 | A * | 9/1998 | Zetterberg | B65D 19/0073 108/51.11 |
| 5,941,179 | A * | 8/1999 | Herring | B65D 19/0095 108/56.3 |
| 6,041,719 | A * | 3/2000 | Vidal | B65D 19/0002 108/56.3 |
| 6,766,749 | B2 * | 7/2004 | Lacabanne | B65D 19/0085 108/901 |
| 6,938,558 | B1 * | 9/2005 | Peres | B65D 19/0095 108/57.25 |
| 8,448,582 | B2 * | 5/2013 | Jian | B65D 19/0097 108/901 |
| 2005/0081764 | A1 * | 4/2005 | Michaels | B65D 19/0012 108/56.3 |
| 2006/0169185 | A1 * | 8/2006 | Williams, Jr. | B65D 19/0095 108/56.3 |
| 2008/0066657 | A1 * | 3/2008 | Kuo | B65D 19/0095 108/56.3 |
| 2013/0136573 | A1 * | 5/2013 | Berry | B65D 19/38 414/800 |
| 2014/0000494 | A1 * | 1/2014 | Gysin | B65D 19/0095 108/56.3 |
| 2014/0238278 | A1 * | 8/2014 | Nepper | B65D 19/004 108/55.1 |
| 2024/0208691 | A1 * | 6/2024 | Gari de León | B65D 19/0024 |

* cited by examiner

DETAIL D

SECTION E-E

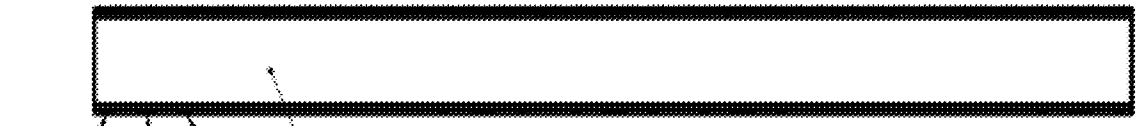
Figure 60
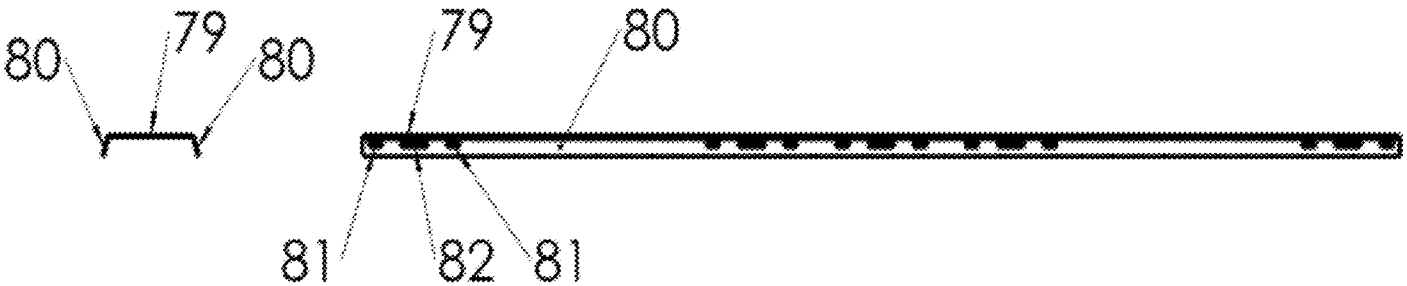
Figure 61
Figure 59

MODULAR PALLET SYSTEM

FIELD OF THE INVENTION

The invention relates, generally, to the field of freight, warehousing, logistics and storage. Specifically, the invention relates to a Pallet for the storage and transport of goods.

BACKGROUND OF THE INVENTION

Wood Pallets form the backbone of the freight and logistics industry, with over 2 billion Pallets in circulation in the United States and 5 billion Pallets globally. The life cycle of a wooden Pallet, however, can be quite brief as supported by the 750 million Pallets manufactured annually in the United States.

Wood is an ideal Pallet material as it is low cost, readily available, light weight, relatively strong and easily processed. Wood "Stringer Pallets" are comprised of 2 or more wood "Stringers" that form the basic internal structure of the Pallet. "Deck Boards" are secured perpendicularly to the upper and lower surfaces of the Stringers. Based on cost and speed of manufacture, wood Pallet components are customarily joined with nails. Stringer Pallets generally utilize 80-120 nails with the final structure able to support heavy loads and facilitate movement using forklifts, Pallet jacks or other motorized equipment.

Common defects associated with nails used to assemble wood Pallets include:

- Nail head pull through
- Nail pull out
- Splitting of Deck Boards or other Pallet structural members Nails, although low cost and fast to install, are the primary cause of Pallet defects and are also the primary obstacle to the repair, refurbishment, reconfiguration, disassembly and disposal of wood Pallets. Further, the basic design and function of wood Pallets does not lend itself to nesting of Pallets and thus requires a large volume required to store and ship.

Eliminating nails from the manufacture of wood Pallets presents a wide range of opportunities including improved repair and refurbishment, extension of service life, ability to reconfigure and improved options for storage, shipping and disposal.

The proposed invention is a Modular Pallet System that utilizes a simple clamping mechanism to eliminate nails traditionally used for the assembly of Pallet structural members. The clamping action is achieved by the opposed translation of adjacent, nested or telescoping structural members. The preferred embodiment comprises nested metal components and the method of actuation is based on threaded fasteners, but actuation could also be achieved by cam, wedge or other mechanical means.

The clamping Stringer system described above provides the basis of a Modular Pallet System. The ability to rapidly assemble and disassemble Pallets is a new paradigm for the Pallet industry and addresses many of the problems associated with wood Pallets.

BRIEF SUMMARY OF THE INVENTION

The invention teaches a Modular Pallet System comprised of Stringer Assemblies and Deck Boards. Stringer Assemblies are assembled from 2 or more elongate members that, when actuated, translate in relation to each other to facilitate location and clamping of Deck Boards. Deck Boards can be manufactured from wood, polymer, composite or metal. Clamping action on Deck Boards can be achieved by screw, wedge, cam or other mechanical means. Clamping action precludes nails or other such fasteners, which facilitates rapid disassembly and reassembly of the Modular Pallet Assembly. Ability to disassemble and reassemble Modular Pallet Assembly facilitates fast and low-cost repair or reconfiguration for different applications that may require different Deck Board materials or change in load capacity. Components are designed, where possible, to stack and nest, providing compact packaging for shipping and storage.

As Pallets can be rapidly disassembled and reassembled, bulk Pallet components can be stored in a compact configuration and assembled "on demand". For example, Pallet components can be manufactured and shipped in bulk to factory setting and assembled when required to load and ship products. Pallets can then be disassembled at point of purchase where the large size and bulk of a Pallet presents a hinderance to commerce. Bulk Pallet components can be stored in a compact configuration for future use or returned and recycled for future use.

When damaged or at end of service life, Pallet can be safely and easily disassembled with components recycled or disposed of as appropriate.

Benefits of proposed Modular Pallet System:

- Elimination of nails eliminates primary source of damage to Palletized goods
- Elimination of nails prevents Deck Boards splitting, thus extending Pallet service life
- Rapid disassembly/reassembly of Pallet facilitates repair and refurbishment of damaged Pallets at any point in supply chain, without special equipment or training
- Unassembled Stringer components and Deck Boards provide very compact configuration for shipping and storage
- Pallets can be easily reconfigured to accept Deck Boards manufactured from different materials, including wood, plastic, metal or other materials
- Pallets can be easily reconfigured to vary load capacity, by varying number and location of Stringer Assemblies
- Pallets can be easily reconfigured to change width dimension of Pallet by using Deck Boards of different length
- Pallets can be easily disassembled for cleaning, sterilization and reassembly when necessary
- Pallets can be easily disassembled and components recycled or scrapped Additional benefits provided by the modular Stringer systems includes ability to attach accessories such as caster wheels, handles and other components that provide increased versatility and value of the proposed Modular Pallet System.

BRIEF DESCRIPTION OF THE DRAWINGS

FIG. 59 depicts front elevation view of formed Metal Deck Board FIG. 60 depicts plan view of formed Metal Deck Board FIG. 61 depicts side elevation view of formed Metal Deck Board

DETAILED DESCRIPTION OF THE INVENTION

Figure 1:
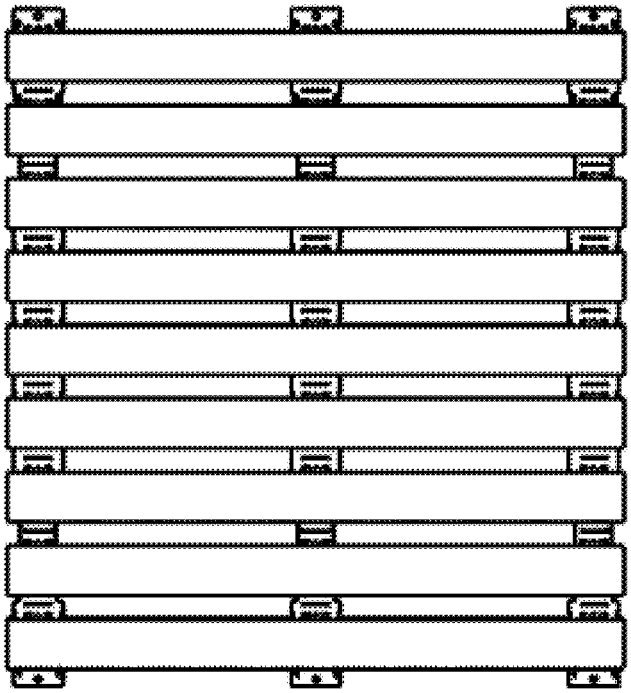
FIG. 1 depicts plan view of Modular Pallet Assembly with 3 Stringer Assemblies and Wood Deck Boards
Figure 2:
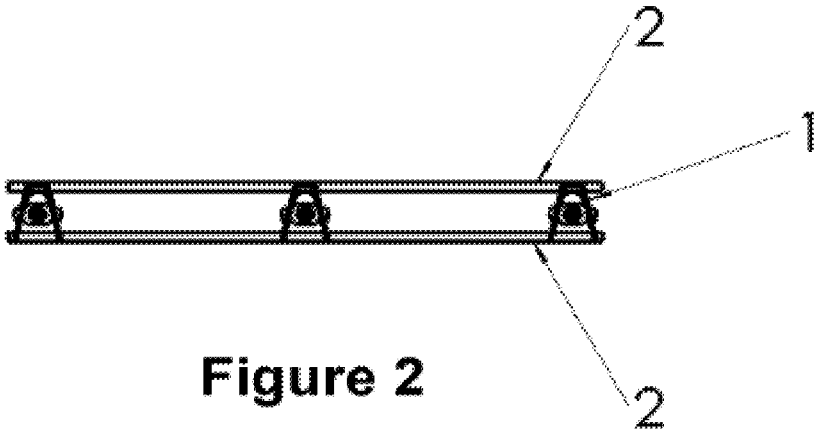
FIG. 2 depicts front elevation view of Modular Pallet Assembly with 3 Stringer Assemblies and Wood Deck Boards
Figure 3:
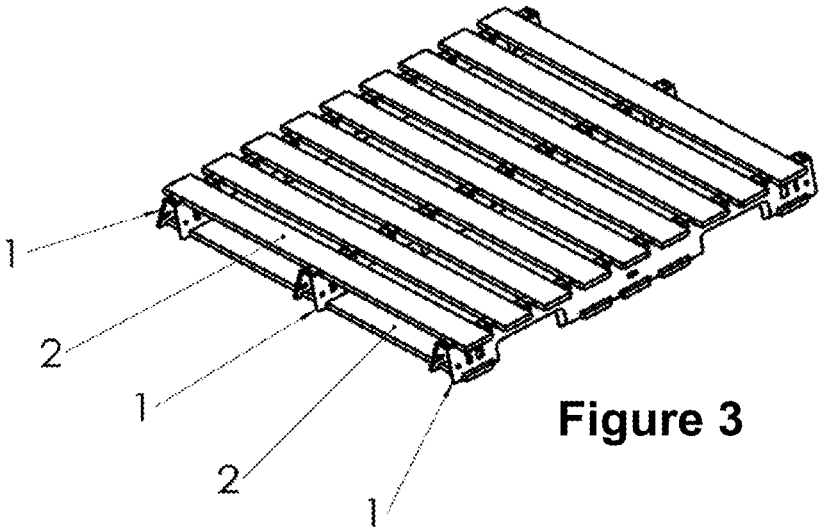
FIG. 3 depicts isometric view of Modular Pallet Assembly with 3 Stringer Assemblies and Wood Deck Boards
Figure 4:
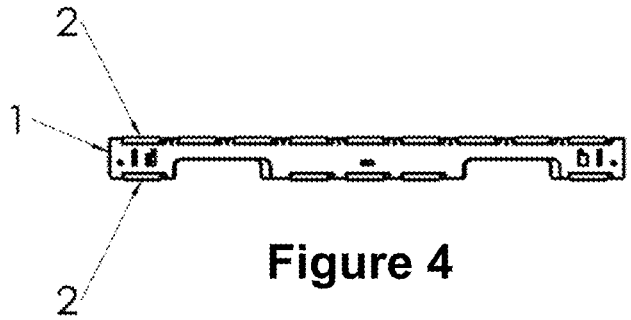
FIG. 4 depicts side elevation view of Modular Pallet Assembly with 3 Stringer Assemblies and Wood Deck Boards
Figure 5:
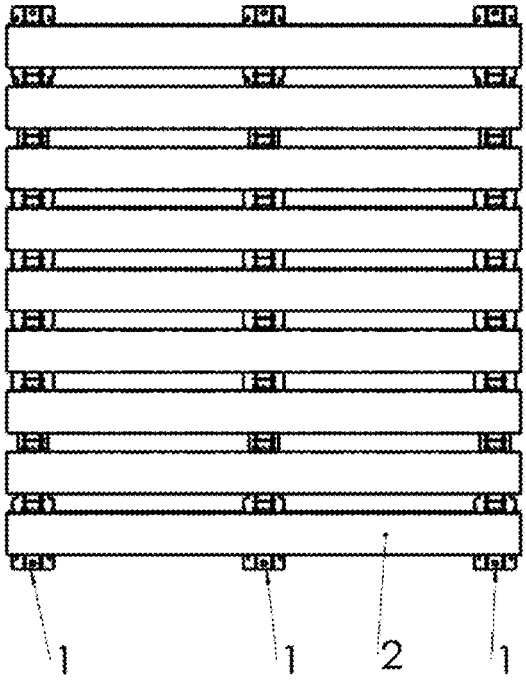
FIG. 5 depicts plan view of Modular Pallet Assembly with 3 Stringer Assemblies and extruded polymer, extruded composite or extruded metal Deck Boards
Figure 6:
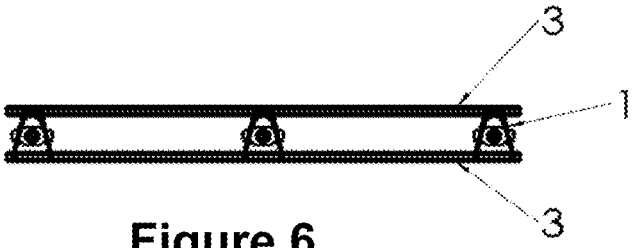
FIG. 6 depicts front elevation view of Modular Pallet Assembly with 3 Stringer Assemblies and extruded polymer, extruded composite or extruded metal Deck Boards
Figure 7:
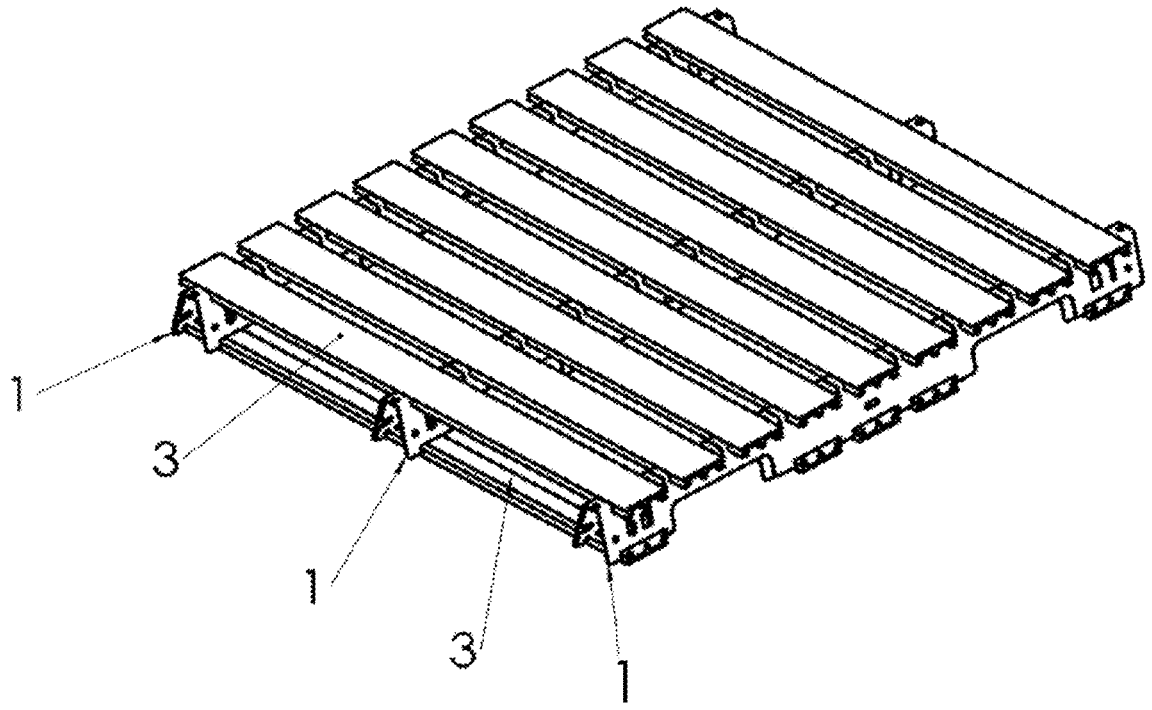
FIG. 7 depicts isometric view of Modular Pallet Assembly with 3 Stringer Assemblies and extruded polymer, extruded composite or extruded metal Deck Boards
Figure 8:
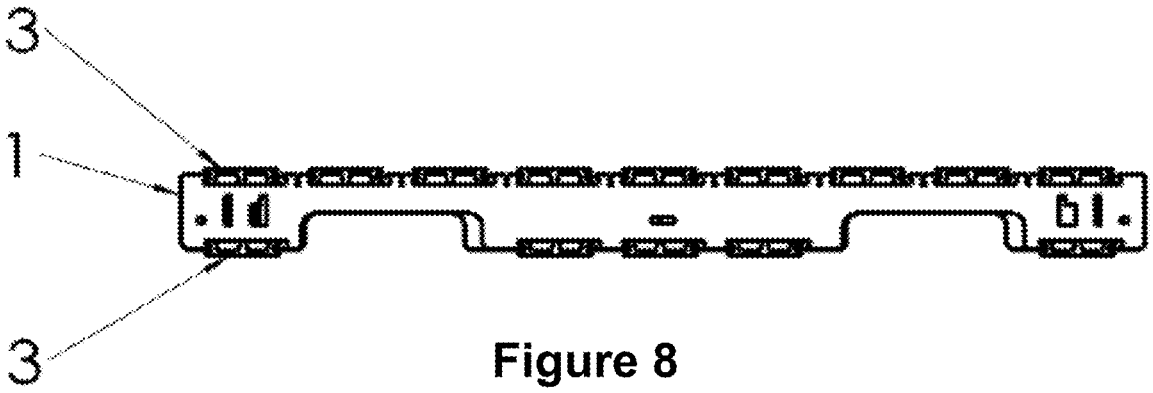
FIG. 8 depicts side elevation view of Modular Pallet Assembly with 3 Stringer Assemblies and extruded polymer, extruded composite or extruded metal Deck Boards
Figure 9:
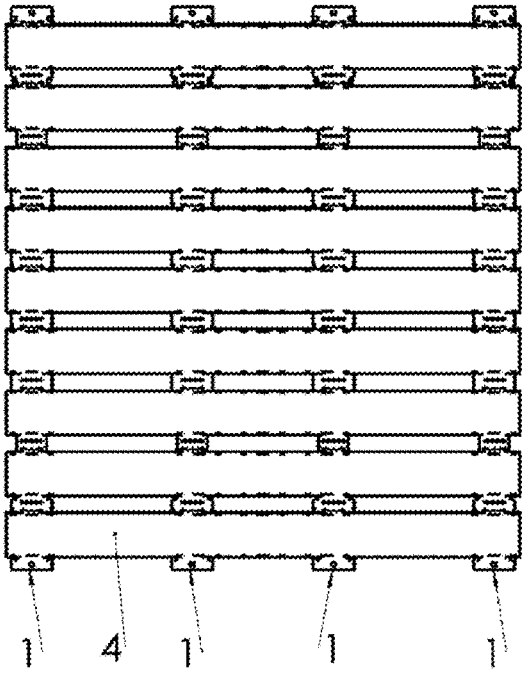
FIG. 9 depicts plan view of Modular Pallet Assembly with 3 Stringer Assemblies and formed metal Deck Boards
Figure 10:
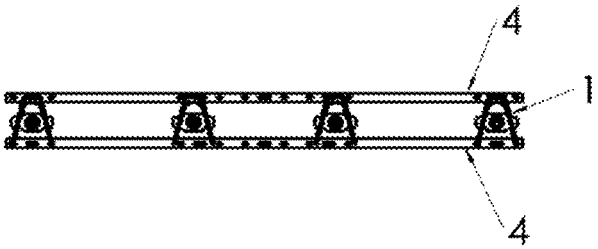
FIG. 10 depicts front elevation view of Modular Pallet Assembly with 4 Stringer Assemblies and formed metal Deck Boards
Figure 11:
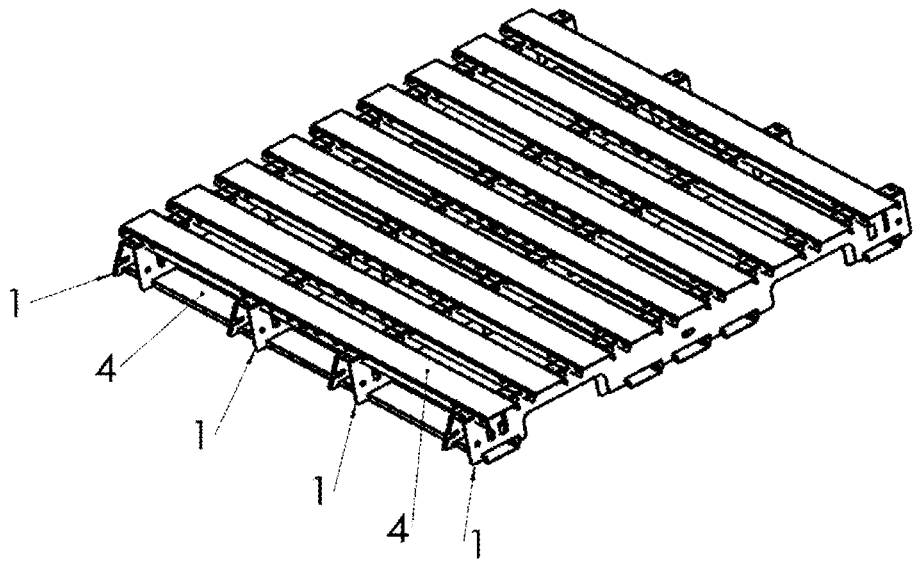
FIG. 11 depicts isometric view of Modular Pallet Assembly with 4 Stringer Assemblies and formed metal Deck Boards
Figure 12:
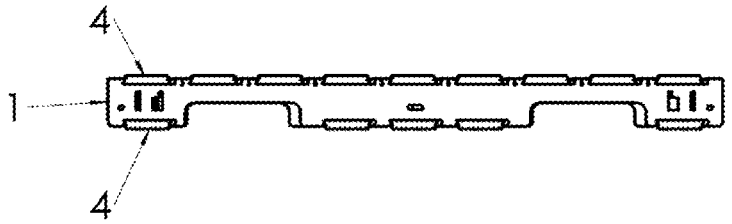
FIG. 12 depicts side elevation view of Modular Pallet Assembly with 4 Stringer Assemblies and formed metal Deck Boards
Figure 13:
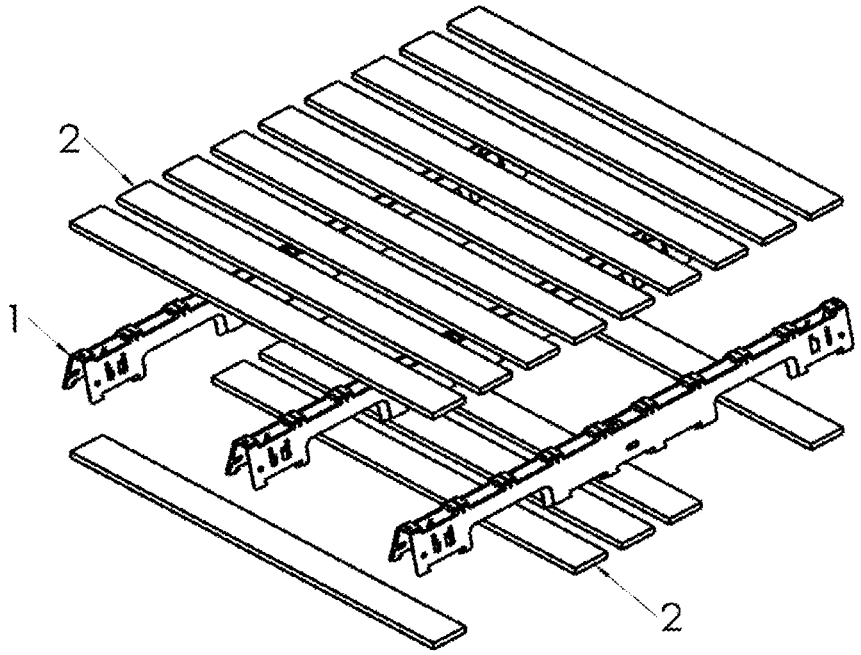
FIG. 13 depicts exploded isometric view of Modular Pallet Assembly with 3 Stringer Assemblies and Wood Deck Boards
Figure 14:
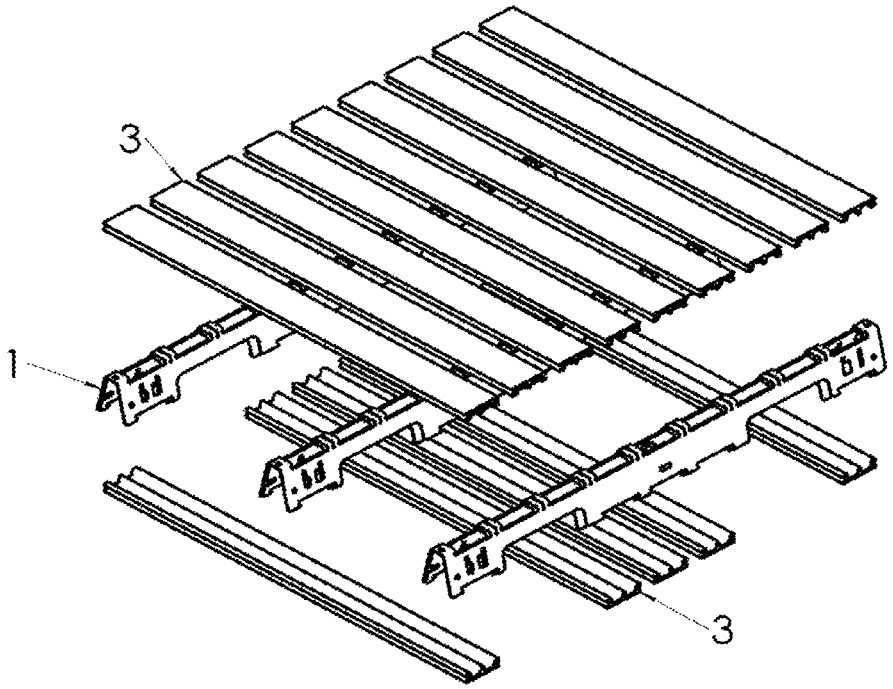
FIG. 14 depicts isometric exploded view of Modular Pallet Assembly with 3 Stringer Assemblies and extruded polymer, extruded composite or extruded metal Deck Boards
Figure 15:
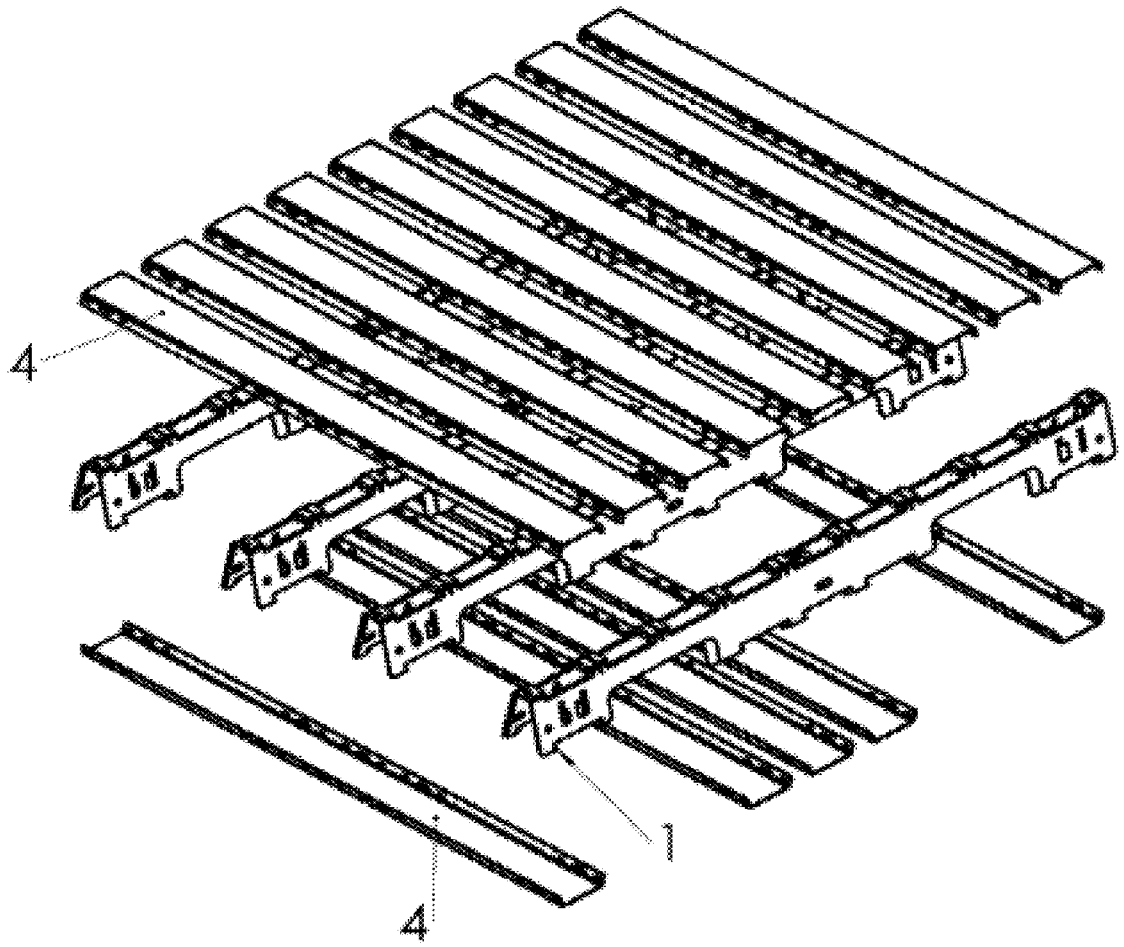
FIG. 15 depicts exploded isometric view of Modular Pallet Assembly with 4 Stringer Assemblies and formed metal Deck Boards

It is specifically intended that the present invention not be limited to the embodiments and illustrations contained herein, but include modified forms of those embodiments including portions of the embodiments and combinations of elements of different embodiments as come within the scope of the following claims.

Referring to FIGS. 1-15, the Modular Pallet Assembly consists of (2) or more Stringer Assemblies and a multitude of Deck Boards. The system is configured to accept Deck Boards of various designs and materials, to accommodate a wide range of industries and applications.

Referring to FIGS. 1-4 and FIG. 13, (3) Stringer Assemblies 1 locate and secure (14) Wood Deck Boards 2. Wood Deck Boards are utilized for commodity applications such as consumer products and industrial components.

Referring to FIGS. 5-8 and FIG. 14, (3) Stringer Assemblies 1 locate and secure (14) extruded polymer, composite or metal Deck Boards 3. Extruded polymer, composite or metal Deck Boards are commonly utilized for sterile applications, such as shipping of medicines and pharmaceuticals or where the danger of wood-borne pests is a concern.

Referring to FIGS. 9-12 and FIG. 15, (3) Stringer Assemblies 1 locate and secure (14) formed Metal Deck Boards 4. Metal Deck Boards are generally utilized for high load and longer term applications such as military and industrial equipment.

Referring to FIGS. 16-18 and FIG. 26, the preferred embodiment of the Stringer Assembly 12 is comprised of 2 elongate, nesting Channels. Alternate embodiments of the Stringer Assembly could include telescoping tubes of various shapes, parallel plates, straight sided channels, nesting hat sections, other shapes and various combinations thereof.

Outer Channel 13 and Inner Channel 14 fit closely, providing secure location and transfer of forces, but are able to freely translate along their length.

Spring Button 19, can be rapidly installed and removed without the use of tools, is installed through slot 33 in Out Channel and hole 48 in Inner Channel. Spring Button 19, secures Inner Channel and Outer Channel together and controls range of translation. With Spring Button 19 at one end of translation, Deck Boards can be properly inserted. With Spring Button 19 at other end of translation, maximum compression of Deck Boards is controlled.

Bolt Plate 16 is inserted transversely though straight slot 27 in Outer Channel 13 and through clearance slot 41 in Inner Channel 14

Nut Plate 18 is inserted transversely though clearance slot 26 in Outer Channel 13 and straight slot 40 in Inner Channel 14.

Bolt 15 is assembled through Bolt Plate 16, through Nut Plate 18 and into Captive Nut 17.

Captive Nut 17, which can be installed and removed without tools, is secured to Nut Plate 18.

It should be noted that, for low cost and minimal complexity, Bolt Plate 16 and Nut Plate 18, although serving different functions, are the same component and are differentiated here only for clarity of function.

Figure 20:
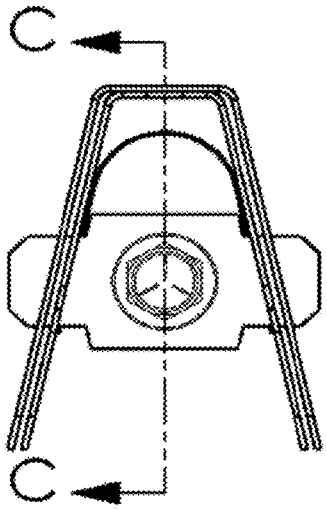
FIG. 20 depicts front elevation view with section lines C-C of Stringer Assembly in unclamped configuration
Figure 21:
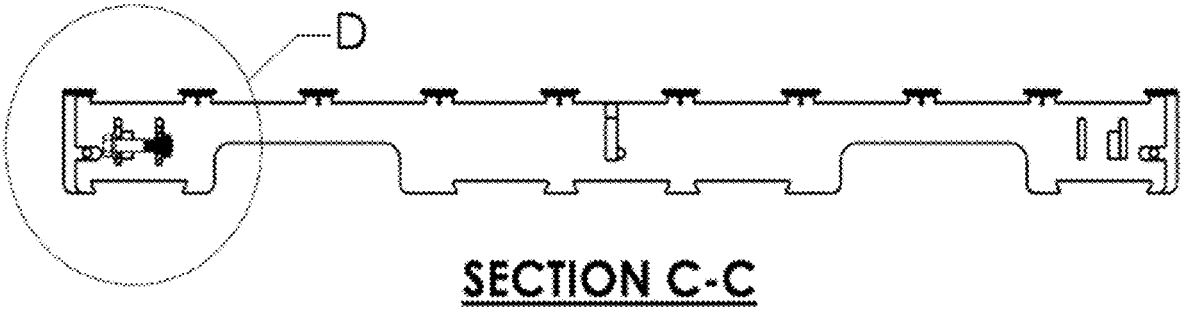
FIG. 21 depicts side elevation section view C-C of Stringer Assembly in unclamped configuration
Figure 22:
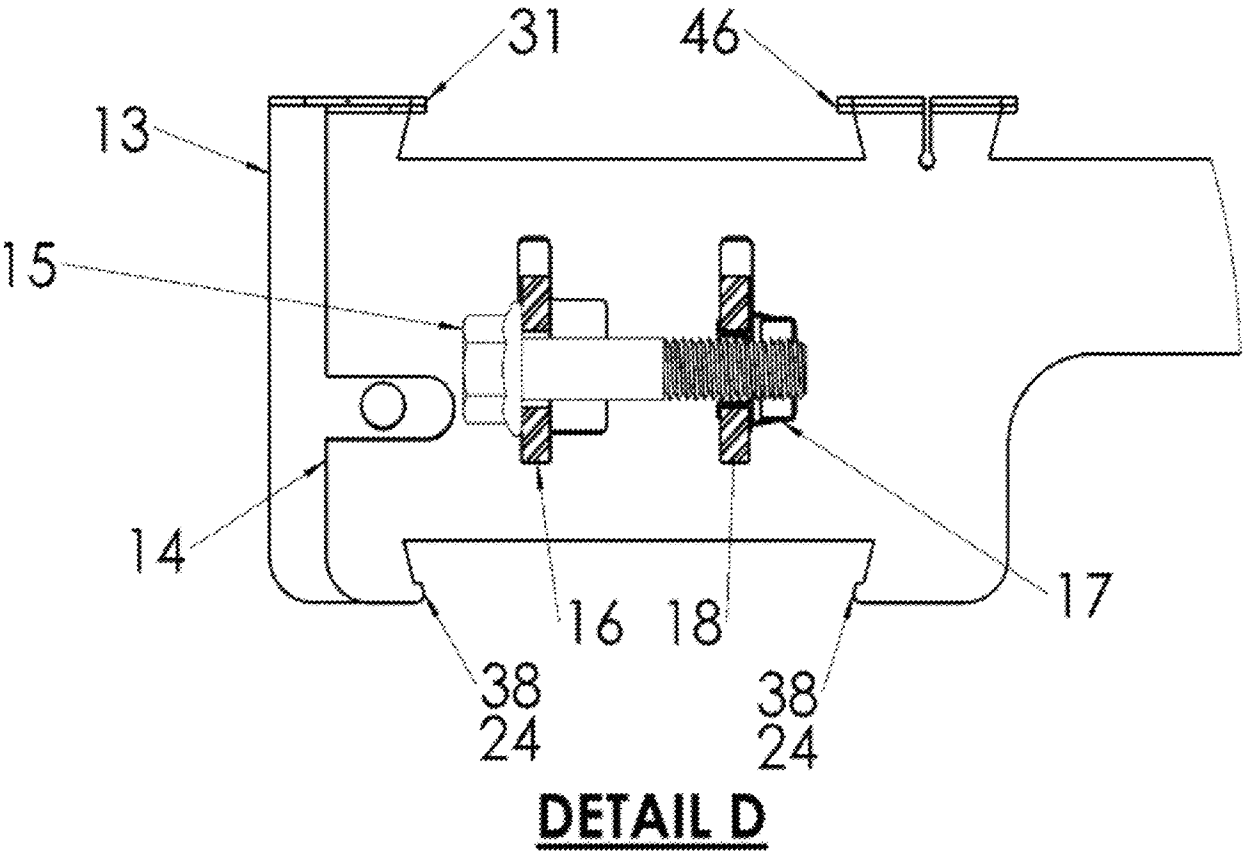
FIG. 22 depicts detail view of side elevation section view C-C of Stringer Assembly in unclamped configuration

Referring to FIG. 20-22, note Outer Channel 13 and Inner Channel 14 are shown in an unclamped configuration with Outer Channel Upper Protrusions 31 and Inner Channel Upper Protrusions 46 aligned. Also aligned are Outer Channel Lower Protrusions 24 and Inner Channel Lower Protrusions 38. In this configuration, Deck Boards can be installed into recesses on the upper and lower surfaces of the Stringer Assembly. In this configuration, Bolt 15 is unactuated and assembled through Bolt Plate 16 and Nut Plate 18 and threaded into Captive Nut 17.

Figure 23:
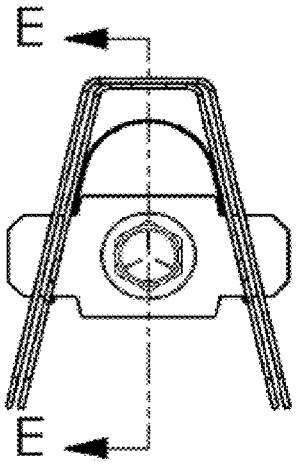
FIG. 23 depicts front elevation view with section lines C-C of Stringer Assembly in clamped configuration
Figure 24:
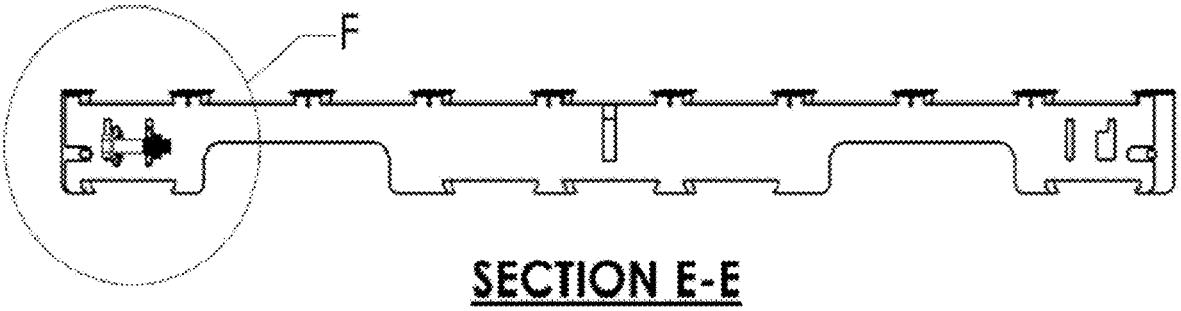
FIG. 24 depicts side elevation section view C-C of Stringer Assembly in clamped configuration
Figure 25:
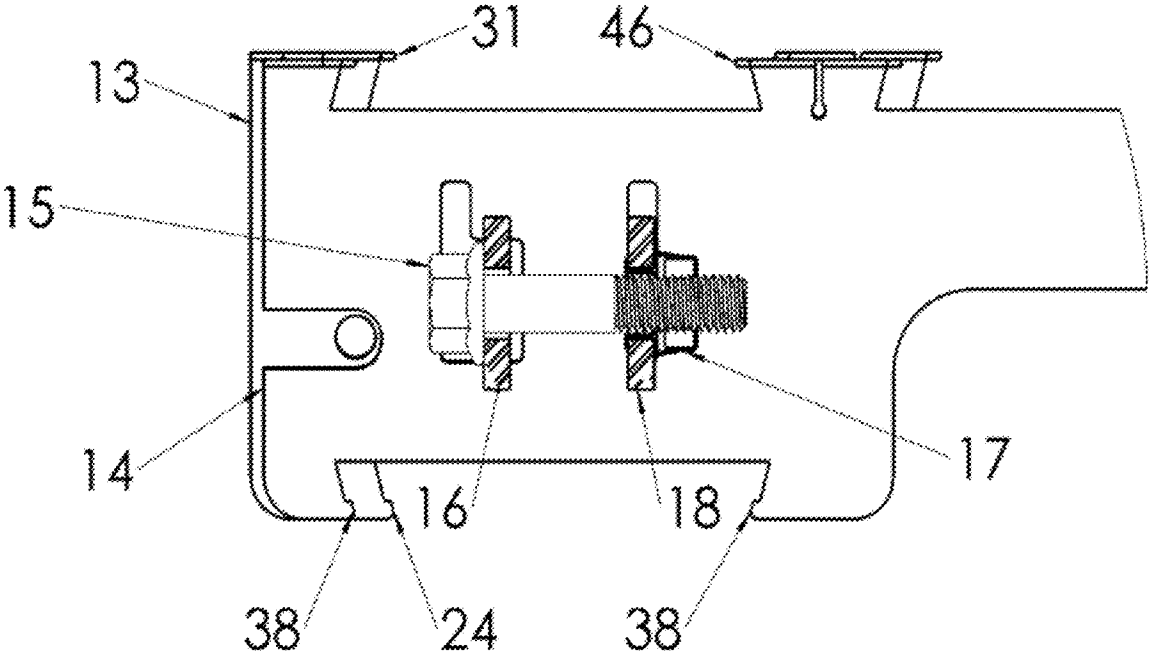
FIG. 25 depicts detail view of side elevation section view C-C of Stringer Assembly in clamped configuration

Referring to FIG. 23-25, note Outer Channel 13 and Inner Channel 14 are shown in a clamped configuration with Outer Channel Upper Protrusions 31 and Inner Channel Upper Protrusions 46 not aligned. Also not aligned are Outer Channel Lower Protrusions 24 and Inner Channel Lower Protrusions 38. In this configuration, Bolt 15 is actuated and assembled through Bolt Plate 16 and Nut Plate 18 and threaded into Captive Nut 17. In this configuration, Deck Boards are clamped in the upper and lower recesses of the Stringer Assembly.

Figure 26:
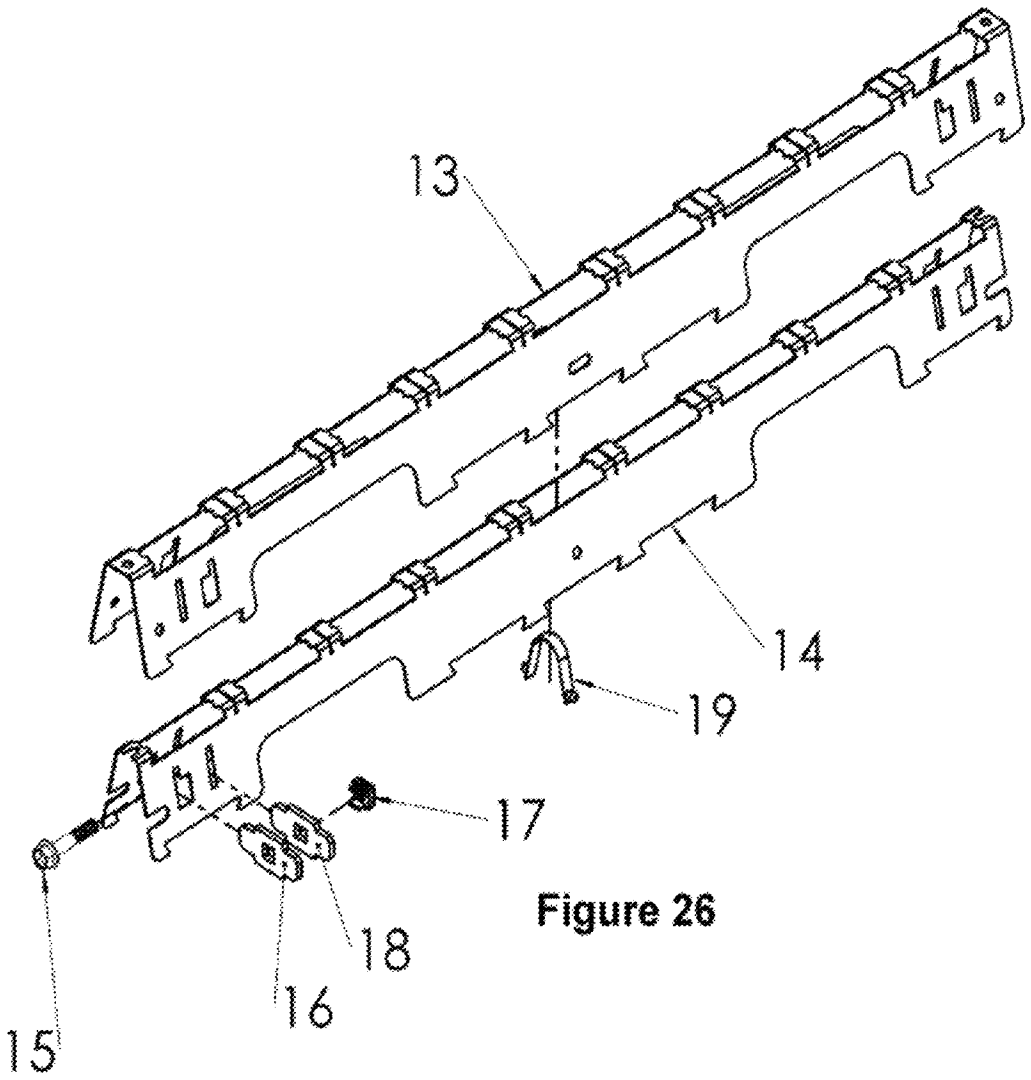
FIG. 26 depicts exploded isometric view of Stringer Assembly
Figure 27:
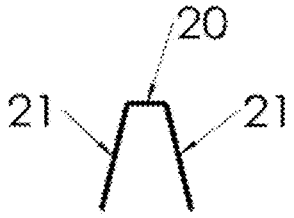
FIG. 27 depicts front elevation view of Outer Stringer Channel
Figure 28:
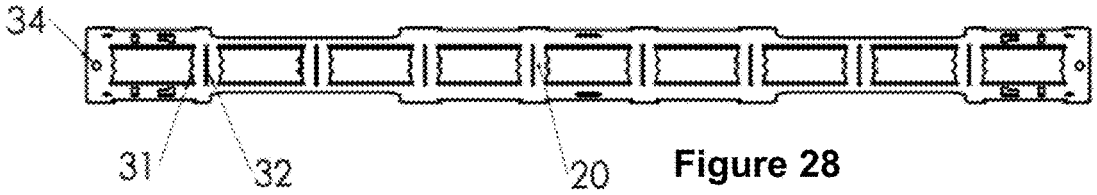
FIG. 28 depicts plan view of Outer Stringer Channel
Figure 29:
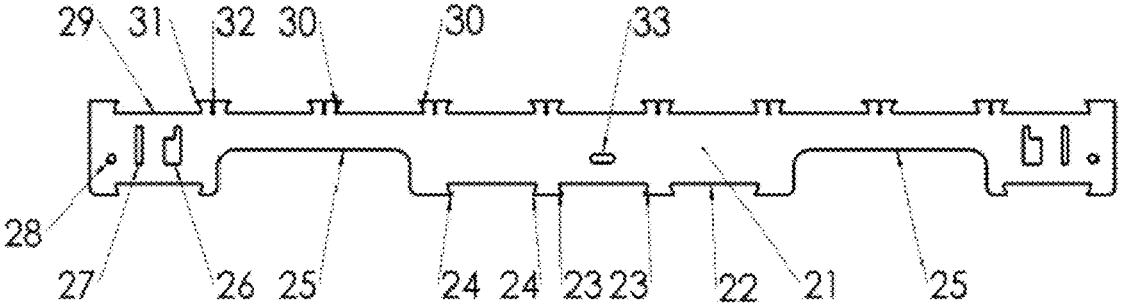
FIG. 29 depicts side elevation view of Outer Stringer Channel
Figure 30:
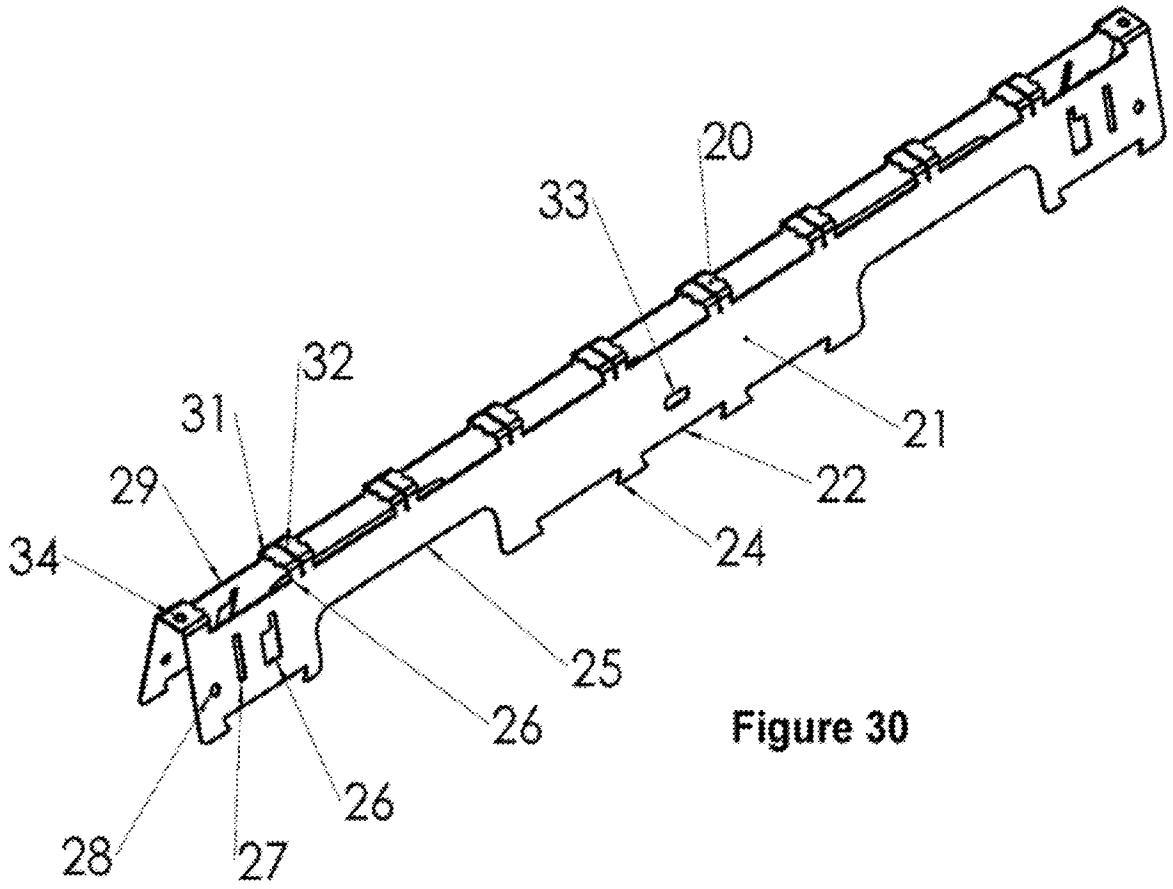
FIG. 30 depicts isometric view of Outer Stringer Channel
Figure 31:
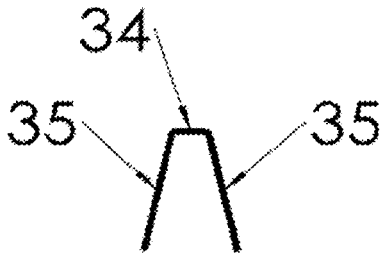
FIG. 31 depicts front elevation view of Inner Stringer Channel
Figure 32:
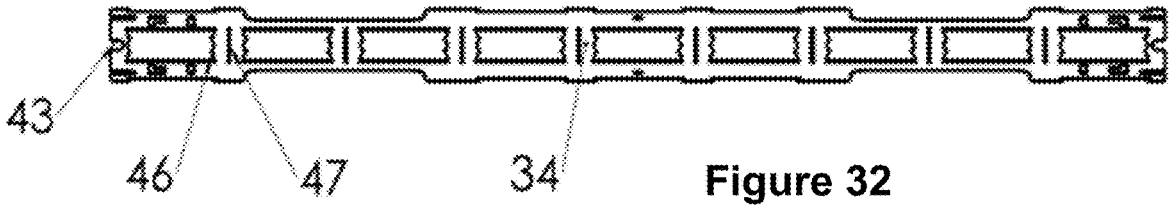
FIG. 32 depicts plan view of Inner Stringer Channel
Figure 33:
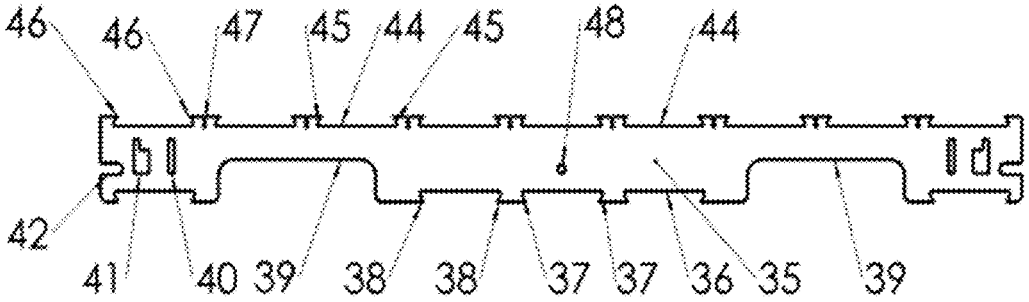
FIG. 33 depicts side elevation view of Inner Stringer Channel
Figure 34:
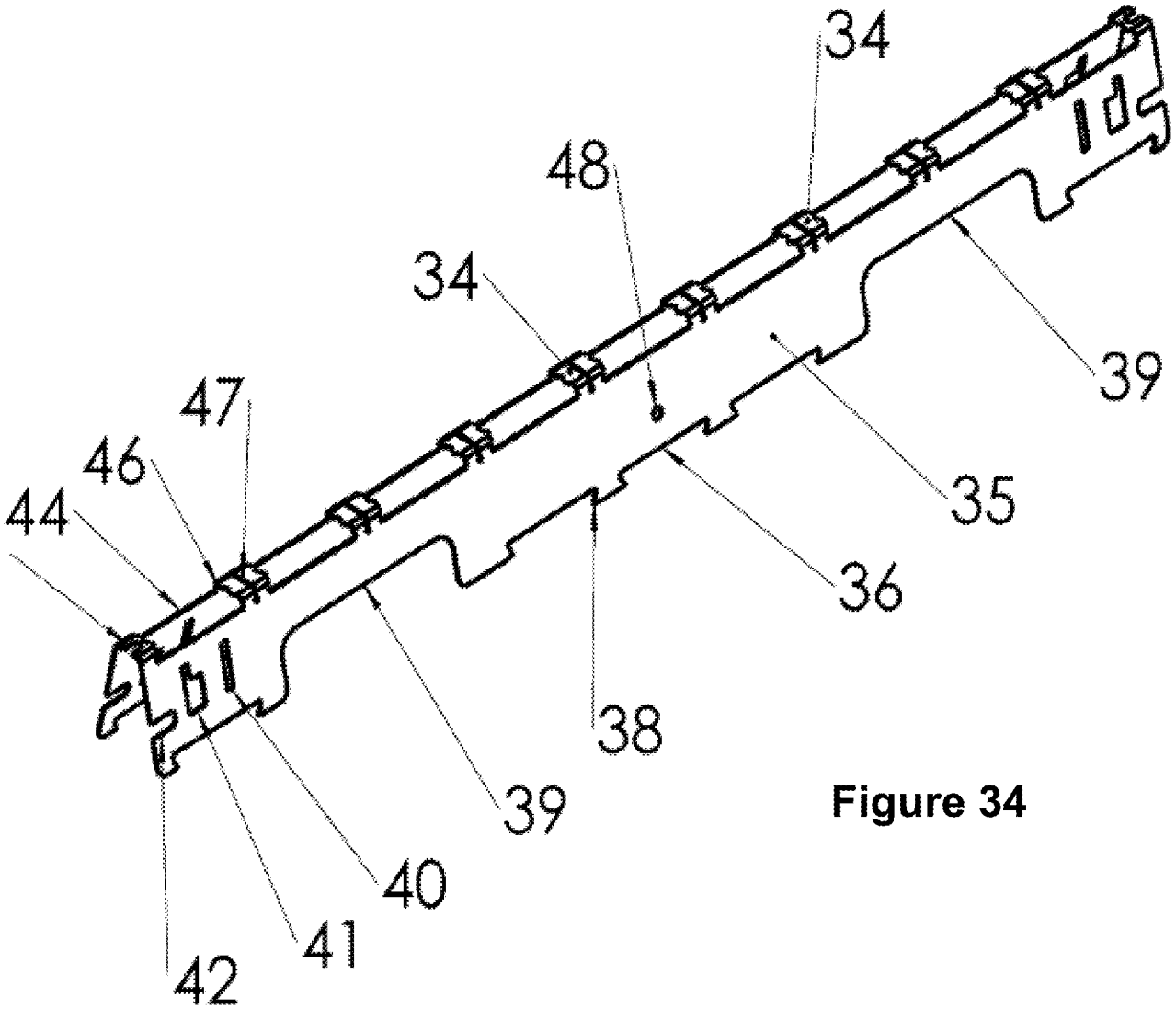
FIG. 34 depicts isometric view of Inner Stringer Channel

Referring to FIG. 26, the simplicity of the Stringer Assembly is depicted with (7) components and (6) unique part numbers. All Stringer Assembly components can be assembled, disassembled, inspected and reassembled without the use of tools, a significant benefit in a Warehouse environment. The only tool required to assemble or disassemble the Modular Pallet Assembly is a powered or manual wrench.

Referring to FIGS. 27-30, the basic structure of the Outer Channel consists of Side Walls 21 connected by Top Surface 20. Note that angled Side Walls 21 of Channel provide the necessary bending strength while also facilitate nesting in a stacked configuration, providing stable and compact storage of components.

Outer Channel 13 can be manufactured from metal or polymer, but preferred embodiment is light gauge steel. Laser cutting can be utilized for lower production volumes with stamping preferred for higher volumes.

Recesses 25 are configured to receive Forklift Forks.

Hole 28 is alternate location for Spring Button 19 and can also be used to locate and secure accessories such as Caster Wheels and Handles, adding functionality for applications such as the Grocery market.

Straight slot 27 receives Bolt Plate 16, which does not translate in relation to Outer Channel 13.

Elongated slot 26 receives Nut Plate 18, which translates in relation to Outer Channel 13.

Upper Deck Board Recess 29 vertically locates and supports all types of Deck Boards.

Angled Recess Surfaces 30 provide a clamping surface for metal and extruded Deck Boards.

Protrusions 31 are formed at both ends of all Upper Deck Board Recesses 29 and serve different functions depending on type of Deck Board. For thicker Wood Deck Boards with vertical side surfaces, Protrusion 31 penetrates Wood Deck Board side surfaces 63 when clamped, locating and securing them. For thin Wood Deck Boards with vertical side surfaces, Protrusions 31 secures Deck Board in Upper Deck Board Recesses 29 and clamping force is provided by Angled Recess Surfaces 30. For Deck Boards with grooved side surfaces, such as those depicted in FIG. 47-54, Protrusions 31 are configured to locate and clamp into the groove features, providing location and resistance to vertical forces. Protrusions 31 locate and secure Metal Deck Boards in Upper Deck Board Recesses 29 using slot 82, depicted in FIGS. 59-62.

Angled Side Surfaces 30 of Upper Deck Board Recesses 29 apply clamping forces to all Deck Boards with angled sided surfaces, including Wood Deck Board with angled side surfaces depicted in FIGS. 43-46, Extruded Deck Board depicted in FIG. 51-54, alternate design Extruded Deck Board depicted in FIGS. 55-58 and Metal Deck Board depicted in FIGS. 59-62.

Lower Deck Board Recess 22 vertically locates and supports all types of Deck Boards.

Angled Recess Surfaces 23 provide a clamping surface for metal and extruded Deck Boards.

Protrusions 24 are formed at both ends of all Lower Deck Board Recesses 22 and serve different functions depending on type of Deck Board.

For Wood Deck Boards with vertical side surfaces, Protrusion 24 penetrates Wood Deck Board side surfaces 63 when clamped, locating and securing them.

For Deck Boards with grooved side surfaces, such as those depicted in FIG. 47-54, Protrusions 24 are configured to locate and clamp into the groove features, providing location and resistance to vertical forces Protrusions 24 locate and secure Metal Deck Boards in Lower Deck Board Recesses 22 using slot 81, depicted in FIGS. 59-62.

Angled Side Surfaces 23 of Lower Deck Board Recesses 22 apply clamping forces to all Deck Boards with angled sided surfaces, including Wood Deck Board with angled side surfaces depicted in FIGS. 43-46, Extruded Deck Board depicted in FIGS. 51-54, alternate design Extruded Deck Board depicted in FIGS. 55-58 and Metal Deck Board depicted in FIGS. 59-62.

Figure 38:
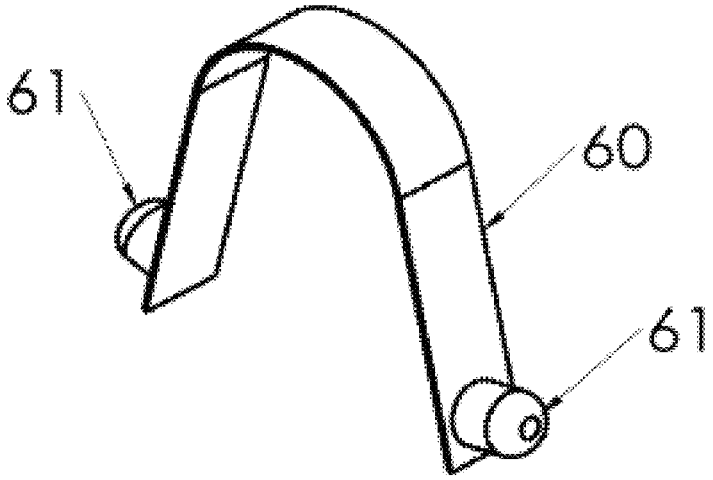
FIG. 38 depicts isometric view of Spring Button Assembly
Figure 40:
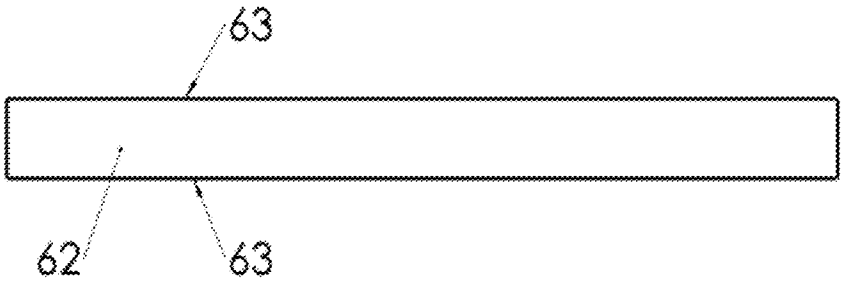
FIG. 40 depicts plan view of of Wood Deck Board with vertical side surfaces
Figure 41:
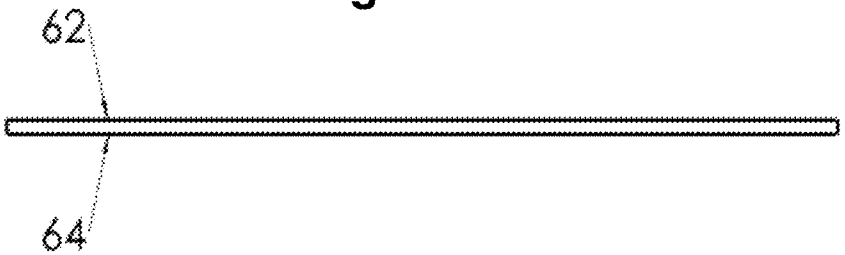
FIG. 41 depicts side elevation view of Wood Deck Board with vertical side surfaces
Figure 39:
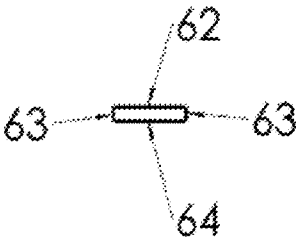
FIG. 39 depicts front elevation view of Wood Deck Board with vertical side surfaces
Figure 42:
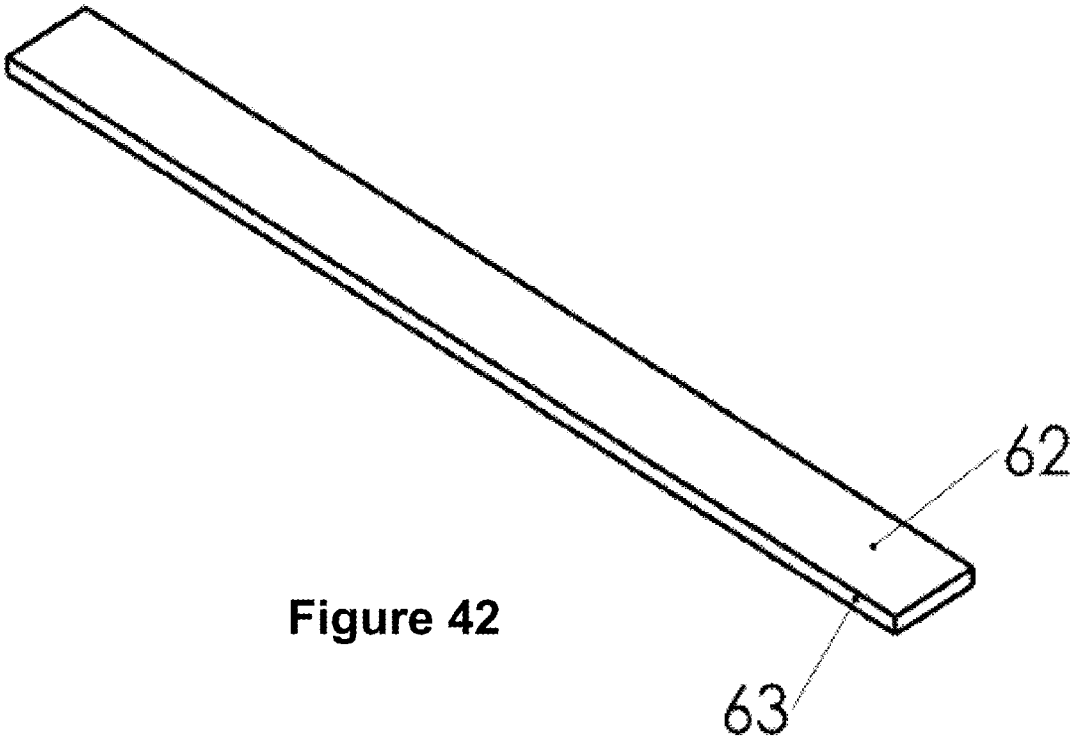
FIG. 42 depicts isometric view of Wood Deck Board with vertical side surfaces
Figure 44:
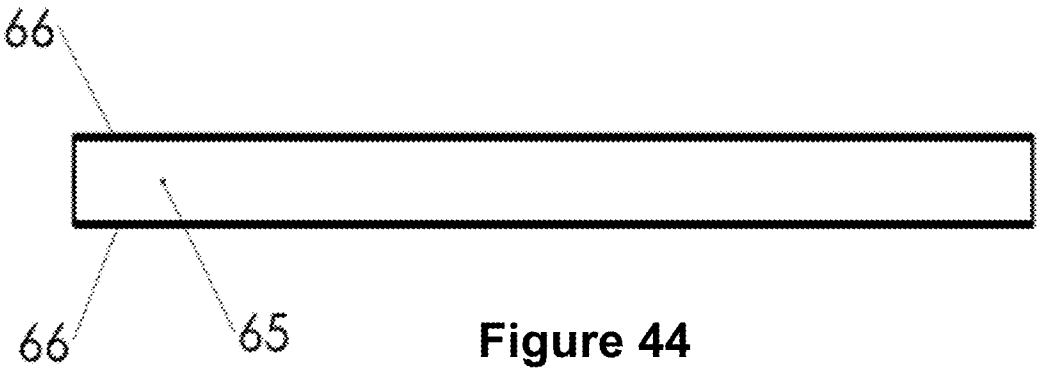
FIG. 44 depicts plan view of of Wood Deck Board with chamfered side surfaces
Figure 45:
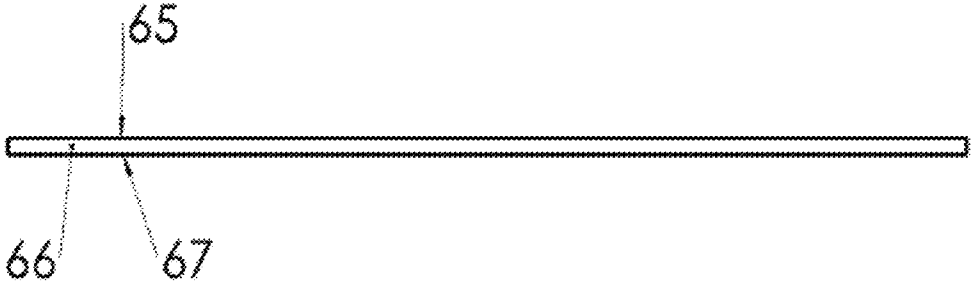
FIG. 45 depicts side elevation view of Wood Deck Board with chamfered side surfaces
Figure 43:
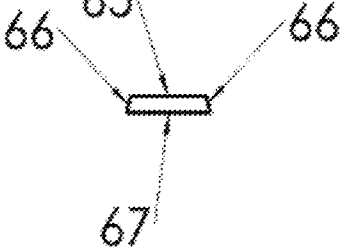
FIG. 43 depicts front elevation view of Wood Deck Board with chamfered side surfaces
Figure 46:
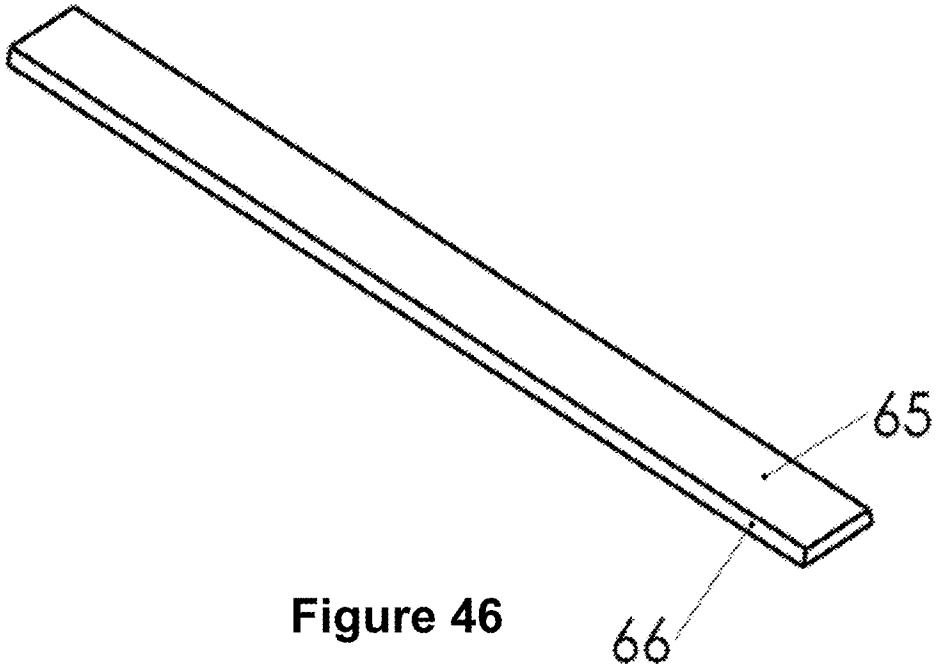
FIG. 46 depicts isometric view of Wood Deck Board with chamfered side surfaces
Figure 48:
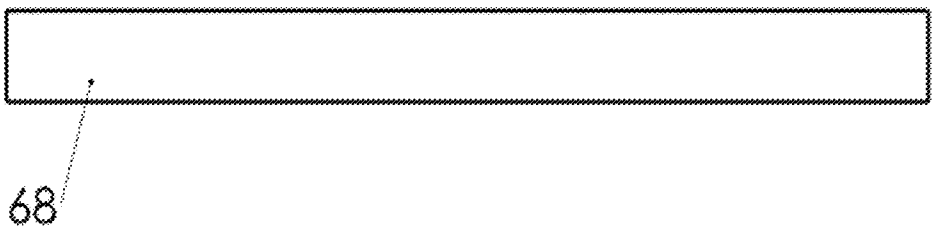
FIG. 48 depicts plan view of milled wood, extruded polymer, extruded composite or extruded metal Deck Board with grooved side surfaces
Figure 49:
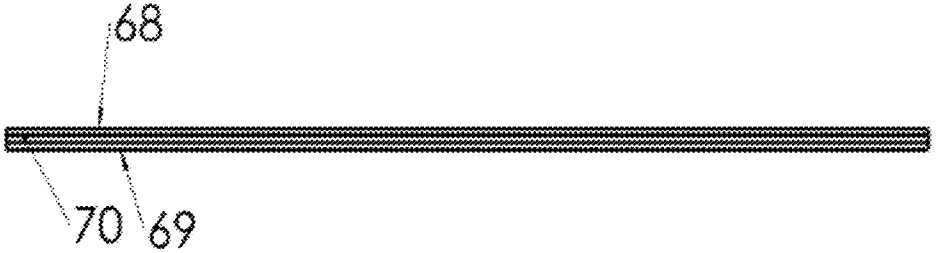
FIG. 49 depicts side elevation view of milled wood, extruded polymer, extruded composite or extruded metal Deck Board with grooved side surfaces
Figure 47:
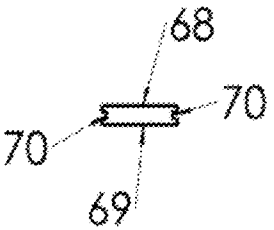
FIG. 47 depicts front elevation view of milled wood, extruded polymer, extruded composite or extruded metal Deck Board with grooved side surfaces
Figure 50:
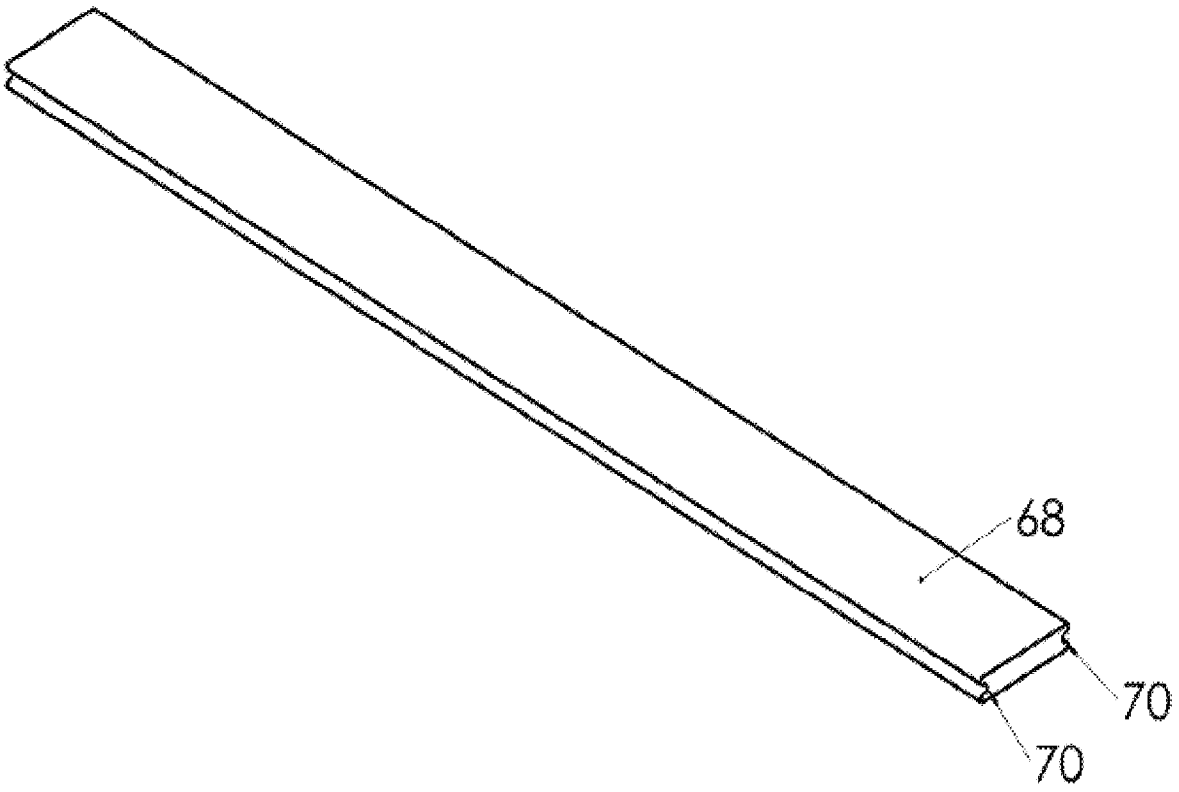
FIG. 50 depicts isometric view of milled wood, extruded polymer, extruded composite or extruded metal Deck Board with grooved side surfaces
Figure 52:
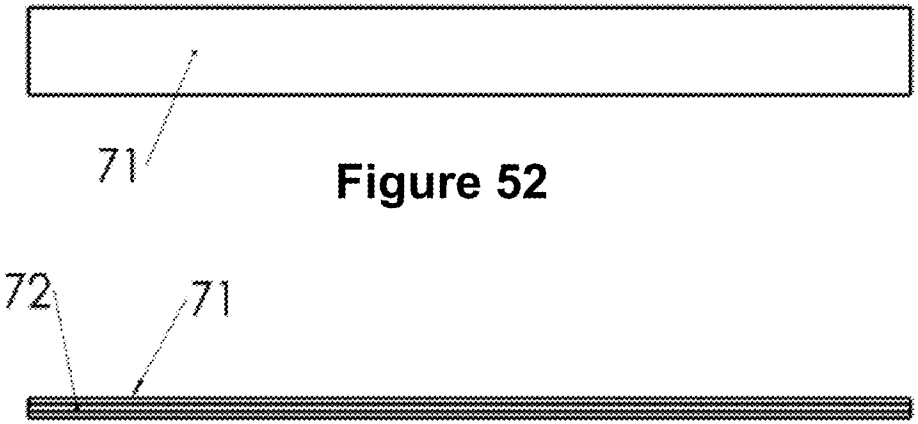
FIG. 52 depicts plan view of extruded polymer, extruded composite or extruded metal Deck Board with grooved side surfaces
Figure 51:
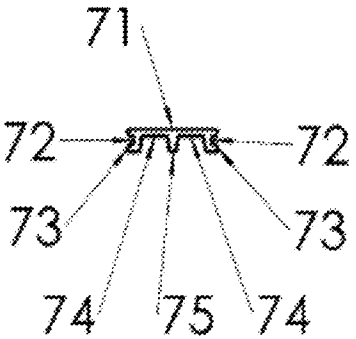
FIG. 51 depicts front elevation view of extruded polymer, extruded composite or extruded metal Deck Board with grooved side surfaces
Figure 53:
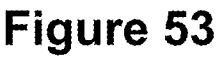
FIG. 53 depicts side elevation view of extruded polymer, extruded composite or extruded metal Deck Board with grooved side surfaces
Figure 54:
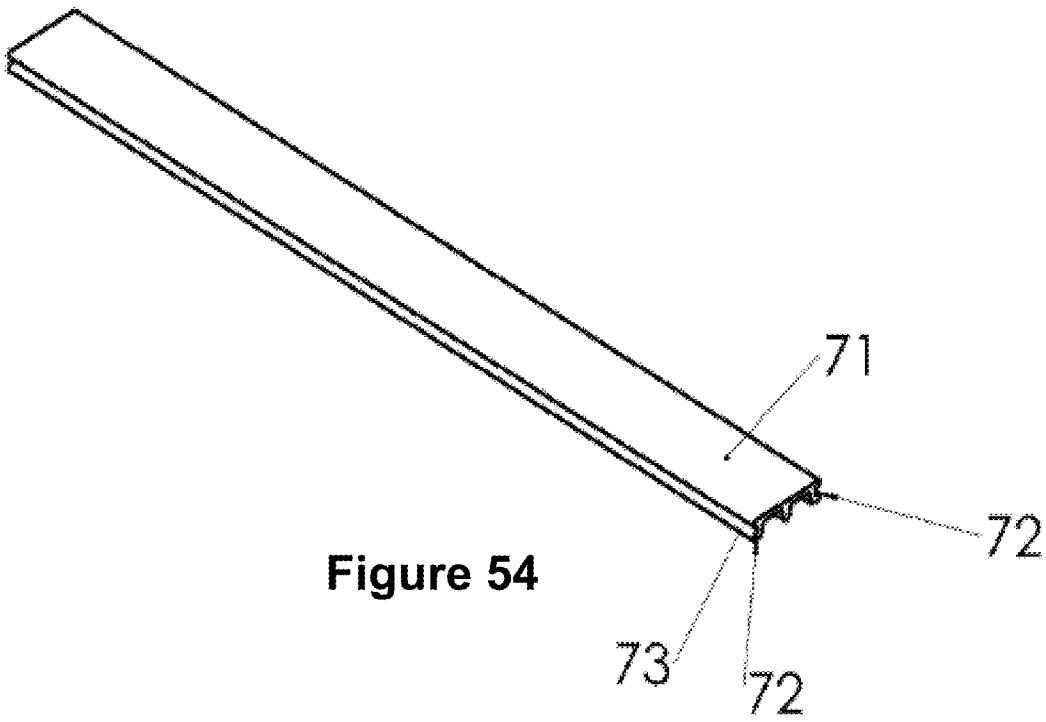
FIG. 54 depicts isometric view of extruded polymer, extruded composite or extruded metal Deck Board with grooved side surfaces
Figure 56:
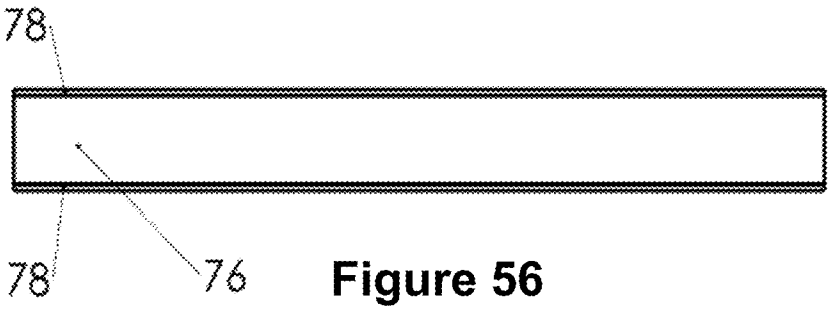
FIG. 56 depicts plan view of alternate design extruded polymer, extruded composite or extruded metal Deck Board
Figure 57:
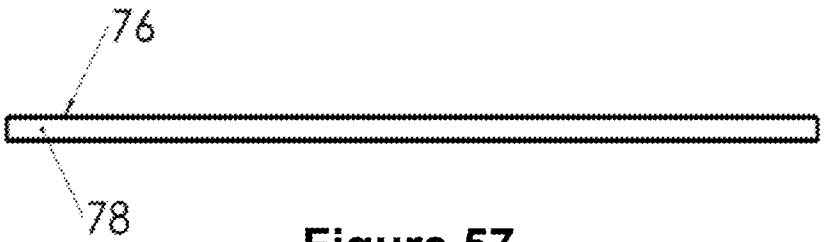
FIG. 57 depicts side elevation view of alternate design extruded polymer, extruded composite or extruded metal Deck Board
Figure 55:
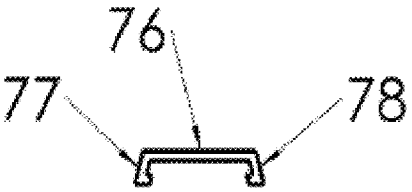
FIG. 55 depicts front elevation view of alternate design extruded polymer, extruded composite or extruded metal Deck Board
Figure 58:
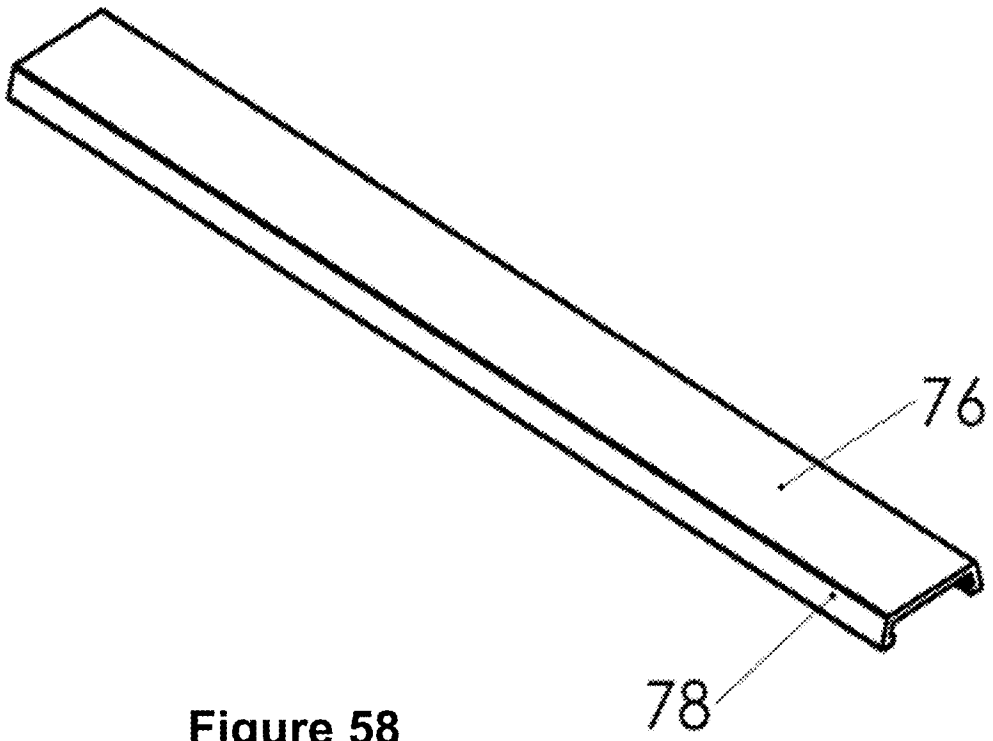
FIG. 58 depicts isometric view of alternate design extruded polymer, extruded composite or extruded metal Deck Board
Figure 62:
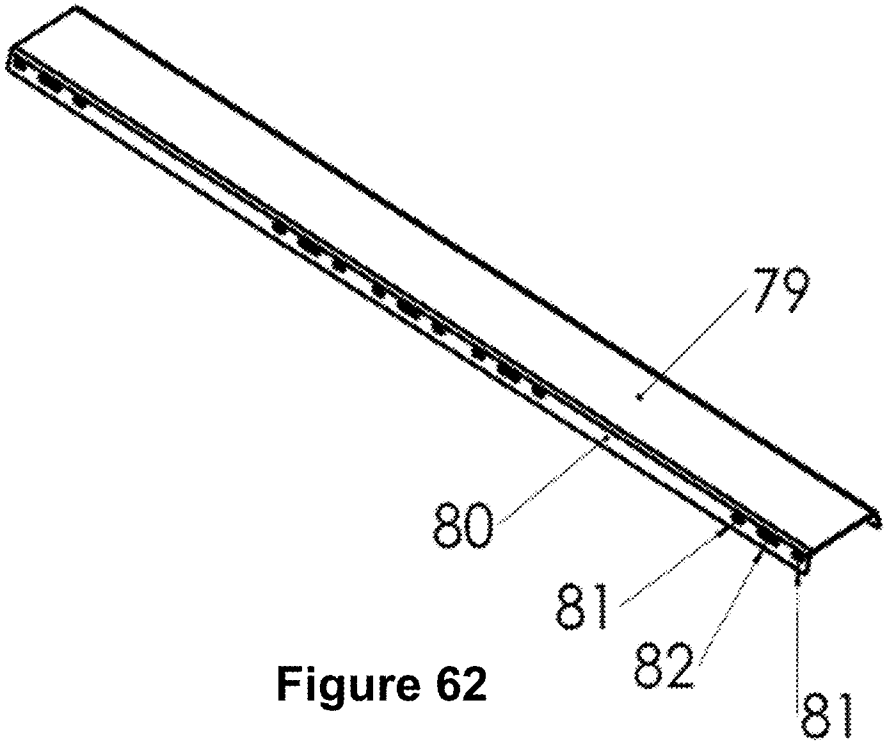
FIG. 62 depicts isometric view of formed Metal Deck Board

Slot 30 receives Spring Button depicted in FIG. 38 and serves to limit range of translation between Outer Channel 13 and Inner Channel 14.

Slot 32 creates a cantilever spring for protrusion, providing ability to control deflection and load transfer to individual Deck Boards when clamping force is applied. This controlled force and deflection allows for Deck Boards of slightly varying widths, which can be the result of manufacturing tolerances or the loss or gain of moisture in Wood Deck Boards.

Note that the Outer Channel is symmetric end-to-end, preventing improper assembly into Stringer Assembly. Mirrored features also provide redundancy for damaged features, providing a more robust component in a warehouse environment.

Referring to FIGS. 31-34, the basic structure of the Inner Channel consists of Side Walls 35 connected by Top Surface 34. Note that angled Side Walls 35 of Channel provide the necessary bending strength while also facilitate nesting in a stacked configuration, providing stable and compact storage of components.

Inner Channel 13 can be manufactured from metal or polymer, but preferred embodiment is light gauge steel. Laser cutting can be utilized for lower production volumes with stamping preferred for higher volumes.

Slot 42 provide clearance for alternate location of Spring Button 19.

Elongated slot 41 receives Bolt Plate 18, which translates in relation to Inner Channel 14.

Recesses 39 are configured to receive Forklift Forks.

Straight slot 40 receives Nut Plate 16, which does not translate in relation to Inner Channel 14.

Upper Deck Board Recess 44 vertically locates and supports all types of Deck Boards.

Angled Recess Surfaces 45 provide a clamping surface for metal and extruded Deck Boards.

Protrusions 46 are formed at both ends of all Upper Deck Board Recesses 44 and serve different functions depending on type of Deck Board. For thicker Wood Deck Boards with vertical side surfaces, Protrusion 46 penetrates Wood Deck Board side surfaces 63 when clamped, locating and securing them. For thin Wood Deck Boards with vertical side surfaces, Protrusions 46 secures Deck Board in Upper Deck Board Recesses 44 and clamping force is provided by Angled Recess Surfaces 45. For Deck Boards with grooved side surfaces, such as those depicted in FIG. 47-54, Protrusions 46 are configured to locate and clamp into the groove features, providing location and resistance to vertical forces. Protrusions 46 locate and secure Metal Deck Boards in Upper Deck Board Recesses 29 using slot 81, depicted in FIGS. 59-62.

Angled Side Surfaces 45 of Upper Deck Board Recesses 44 apply clamping forces to all Deck Boards with angled sided surfaces, including Wood Deck Board with angled side surfaces depicted in FIGS. 43-46, Extruded Deck Board depicted in FIG. 51-54, alternate design Extruded Deck Board depicted in FIGS. 55-58 and Metal Deck Board depicted in FIGS. 59-62.

Lower Deck Board Recess 36 vertically locates and supports all types of Deck Boards.

Angled Recess Surfaces 37 provide a clamping surface for metal and extruded Deck Boards.

Protrusions 38 are formed at both ends of all Lower Deck Board Recesses 36 and serve different functions depending on type of Deck Board.

For Wood Deck Boards with vertical side surfaces, Protrusion 38 penetrates Wood Deck Board side surfaces 63 when clamped, locating and securing them.

For Deck Boards with grooved side surfaces, such as those depicted in FIG. 47-54, Protrusions 38 are configured to locate and clamp into the groove features, providing location and resistance to vertical forces Protrusions 38 locate and secure Metal Deck Boards in Lower Deck Board Recesses 22 using slot 81, depicted in FIGS. 59-62.

Angled Side Surfaces 37 of Lower Deck Board Recesses 36 apply clamping forces to all Deck Boards with angled sided surfaces, including Wood Deck Board with angled side surfaces depicted in FIGS. 43-46, Extruded Deck Board depicted in FIG. 51-54, alternate design Extruded Deck Board depicted in FIGS. 55-58 and Metal Deck Board depicted in FIGS. 59-62.

Hole 48 receives Spring Button 19 depicted in FIG. 38 and serves to limit range of translation between Outer Channel 13 and Inner Channel 14.

Slot 47 creates a cantilever spring for protrusion, providing ability to control deflection and load transfer to individual Deck Boards when clamping force is applied. This controlled force and deflection allows for Deck Boards of slightly varying widths, which can be the result of manufacturing tolerances or the loss or gain of moisture in Wood Deck Boards.

Note that the Inner Channel is symmetric end-to-end, preventing improper assembly into Stringer Assembly. Mirrored features also provide redundancy for damaged features, providing a more robust component in a warehouse environment.

Figure 35:
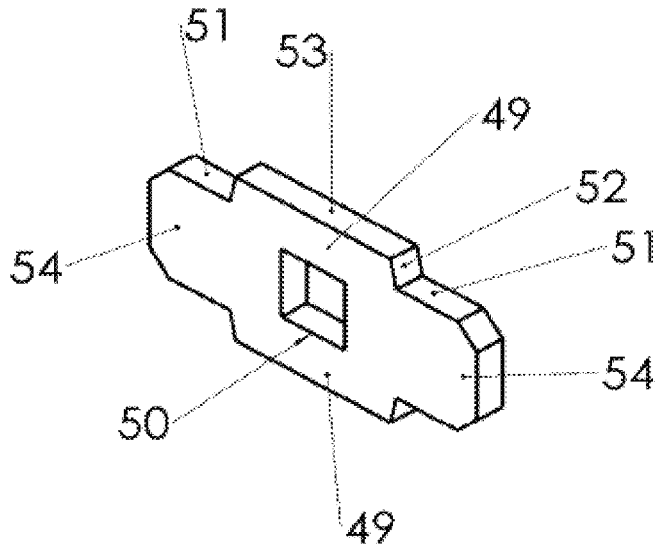
FIG. 35 depicts isometric view of Bolt Plate/Nut Plate

Referring to FIG. 35, the basic structure of the Bolt Plate 16 and Nut Plate 18 is a robust planar body 49 with the necessary bending and shear strength required to resist the large clamping forces applied by Bolt 15 and Captive Nut 17. Bolt Plate 16 or Nut Plate 18 can be manufactured from metal, but the preferred embodiment is 0.25 in. thick mild steel. Laser cutting can be utilized for lower production volumes with stamping preferred for higher volumes.

The internal square hole 50 is configured to receive Captive Nut 17 but also provides the required clearance to facilitate installation of Bolt 15.

Surfaces 54 provides a large area to grip between thumb and forefinger during manual insertion and removal of Bolt Plate 16 and Nut Plate 18 into Stringer Assembly 1.

Surfaces 54 also provides a large surface area to distribute clamping forces to slot 27 on Outer Channel and slot 40 on Inner Channel. Surface 54 surface must be long enough to produce bearing pressures on edges of slots 27 and 40 less than material yield strength of either Bolt Plate 16, Nut Plate 18, Outer Channel 13 or Inner Channel 14.

Surfaces 51 locate the Bolt Plate and Nut Plate vertically in slot 27 on Outer Channel and in slot 40 on Inner Channel.

Figure 16:
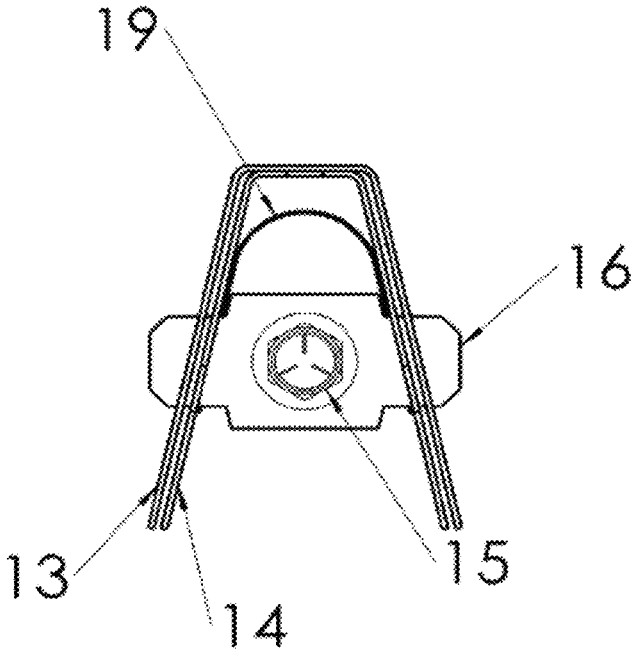
FIG. 16 depicts front elevation view of Stringer Assembly
Figure 17:
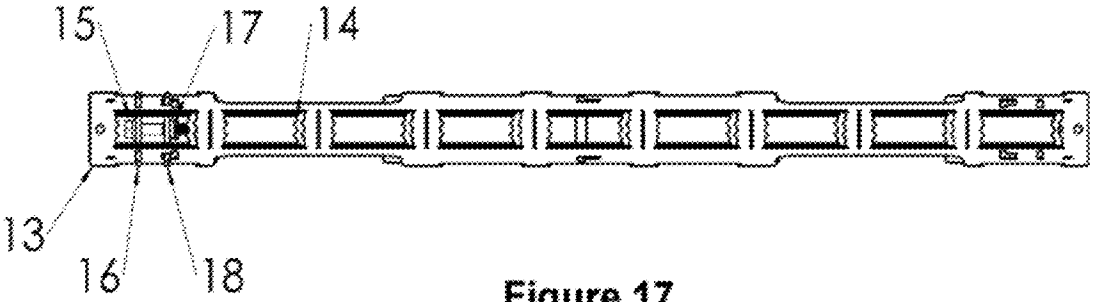
FIG. 17 depicts plan view of Stringer Assembly in clamped configuration
Figure 18:
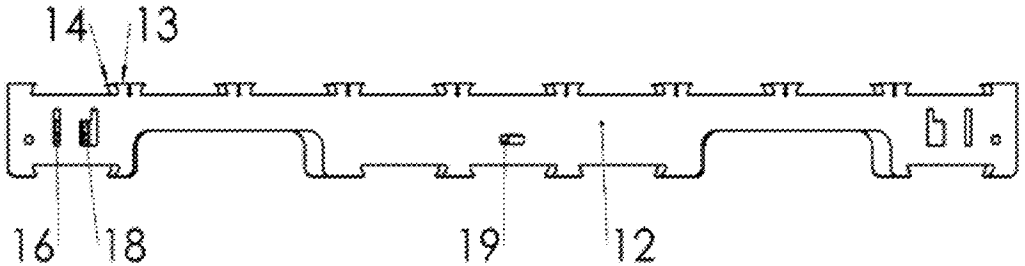
FIG. 18 depicts side elevation view of Stringer Assembly in clamped configuration
Figure 19:
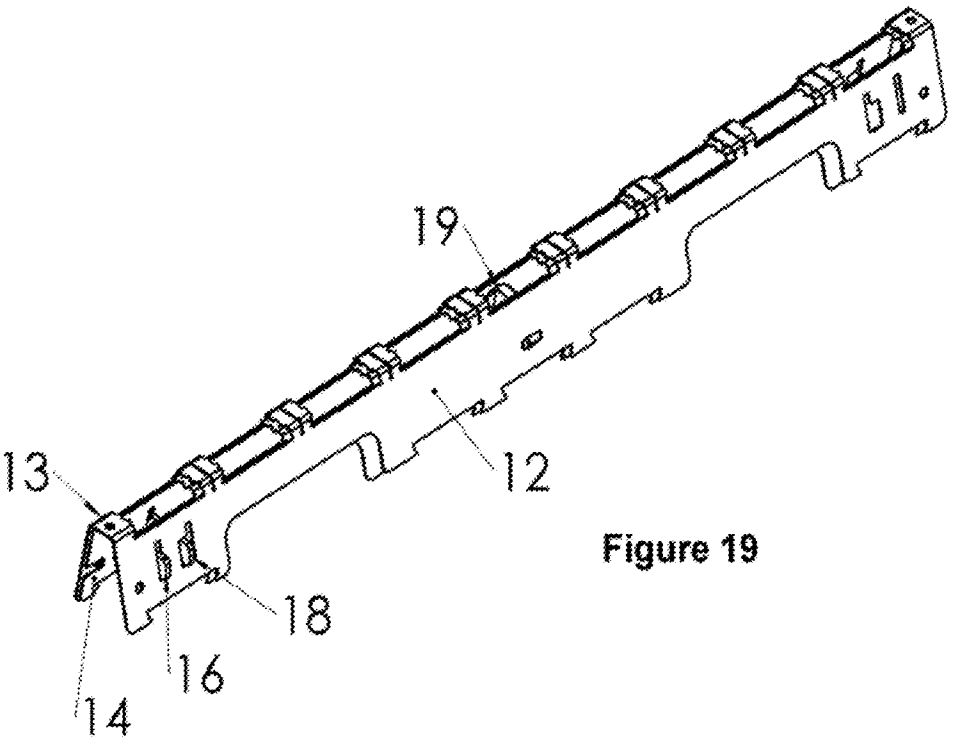
FIG. 19 depicts isometric view of Stringer Assembly in clamped configuration

Surfaces 52 provide a transition to an increased section at the midspan of the component where bending stresses are highest. Surfaces 52 are angled to provide clearance for translation inside Side Walls Inner Channel 14. Refer to FIG. 16 for more information.

Note that Bolt Plate 16 and Nut Plate 18 has multiple axes of symmetry, preventing improper assembly into Stringer Assembly 1.

Figure 36:
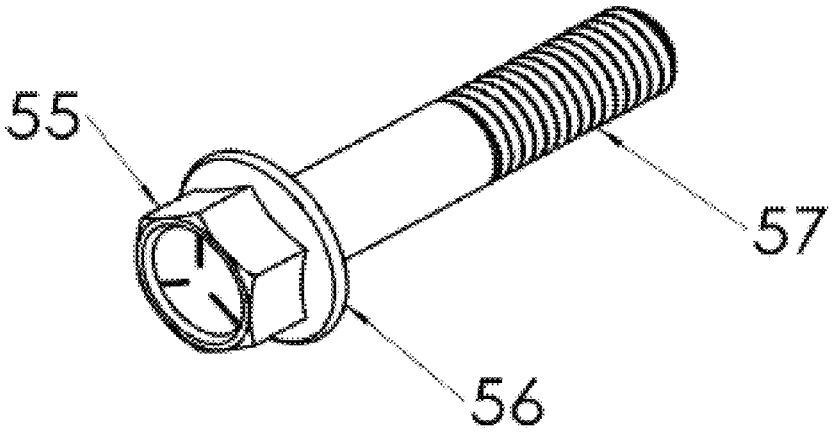
FIG. 36 depicts isometric view of Bolt

Referring to FIG. 36, Bolt 15 is a commercially available threaded fastener. The preferred embodiment is nominally a ½-13 Grade 5 Hex Washer Head Bolt.

Hex feature 55 provides robust method of actuation for installation, removal and clamping Deck Boards.

Washer Head feature 56 provides a large surface to distribute loads against surface 49 of Bolt Plate.

Screw threads 57 are inserted into Nut 17 to provide method of translating Outer Stringer 13 and Inner Stringer 14 and applying clamping loads to Deck Boards.

Figure 37:
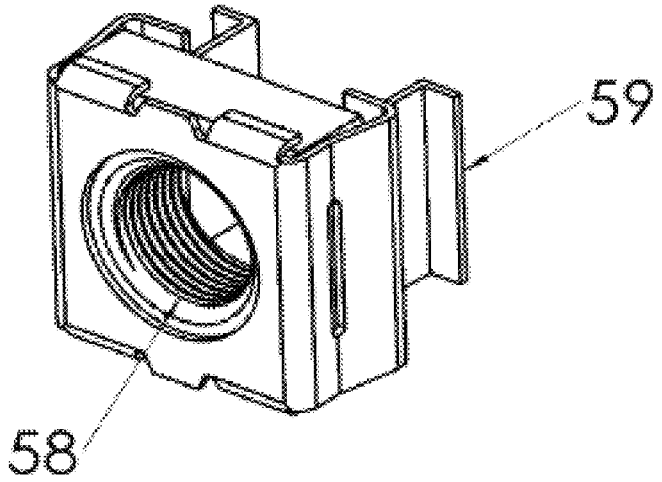
FIG. 37 depicts isometric view of Captive Nut

Referring to FIG. 37, Captive Nut 37 is a commercially available Nut. The preferred embodiment is a ½-13 Grade 2 Cage Nut.

Screw threads 58 receive threads 57 on Bolt 15.

Spring loaded fingers 59 are manually compressed with thumb and forefinger to facilitate installation and removal of Captive Nut into internal square hole 50 of Nut Plate 18.

Referring to FIG. 38, Spring Button Assembly 19 is a commercially available component utilized for various purposes such as connecting telescoping tubing.

The Spring Button Assembly can be installed and removed without tools by compressing Pins 61 between thumb and forefinger, thereby flexing body 60 and withdrawing Pins 61 from slot 33 in Out Channel 13 and hole 48 in Inner channel 14.

The preferred embodiment of Spring Button Assembly 19 includes Pins 61 approximately 0.375 in. in diameter and 0.375 in. in length.

Referring to FIG. 39-42, Wood Deck Board 2 is a commercially available hardwood or softwood Deck Board, commonly used for manufacturing wood Pallets.

Top Surface 62 provides support for packages loaded on Modular Pallet Assembly or is located in Lower Deck Board Recesses 22 of Outer Channel or Lower Deck Board Recesses 36 of Inner Channel to provide support on grade.

Bottom Surface 64 provides support for Modular Pallet Assembly on grade or is located in Upper Deck Board Recesses 29 of Outer Channel 13 or Upper Deck Board Recesses 44 of Inner Channel 14.

Vertical Side Surfaces 63 are clamped and located by protrusions 31 on Outer Channel 13 or protrusions 46 on Inner Channel 14.

Referring to FIG. 43-46, Wood Deck Board with Chamfered Side Surfaces is manufactured from hardwood or softwood.

Top Surface 65 provides support for packages loaded on Modular Pallet Assembly or is inverted and located in Lower Deck Board Recesses 22 of Outer Channel or Lower Deck Board Recesses 36 of Inner Channel to provide support on grade. Board thickness is such that Top Surface 65 is retained under Protrusions 31 on Outer Channel 13 and Protrusions 46 on Inner Channel 14.

Bottom Surface 67 is located in Upper Deck Board Recesses 29 of Outer Channel 13 and Upper Deck Board Recesses 44 of Inner Channel 14. Bottom Surface 67 is located in Outer Lower Deck Board Recesses 22 Inner Lower Deck Board Recesses 36 to provide support for Modular Pallet Assembly.

Deck Board Angled Side Surfaces 66 are clamped by Angled Side Surfaces 30 of Upper Deck Board Recesses 29 in Outer Channel 13, Angled Side Surfaces 23 of Lower Deck Board Recesses 22 in Outer Channel 13, Angled Side Surfaces 45 of Upper Deck Board Recesses 44 in Inner Channel 14 and Angled Side Surfaces 23 of Lower Deck Board Recesses 36 in Inner Channel 14.

Referring to FIG. 47-50, Deck Board with grooved side surfaces can be manufactured from milled wood, extruded polymer, extruded composite or extruded metal.

Top Surface 68 provides support for packages loaded on Modular Pallet Assembly or is located in Lower Deck Board Recesses 22 of Outer Channel 13 or Lower Deck Board Recesses 36 of Inner Channel 14

Bottom Surface 69 provides support for Modular Pallet Assembly on grade or is located in Upper Deck Board Recesses 29 of Outer Channel 13 or Upper Deck Board Recesses 44 of Inner Channel 14.

Grooved Side Surfaces 70 are configured to receive and be clamped and located by protrusions 31 and 24 of Outer Channel 13 and protrusions 46 and 38 of Inner Channel 14.

Referring to FIG. 51-54, Extruded Deck Board with Grooved Sides can be manufactured from extruded polymer, extruded composite or extruded metal.

Top Surface 71 provides support for packages loaded on Modular Pallet Assembly or is inverted and located in Lower Deck Board Recesses 22 of Outer Channel 13 and Lower Deck Board Recesses 36 of Inner Channel 14 to provide support on grade provide.

Grooved Side Surfaces 72 are configured to receive and be clamped and located by protrusions 31 and 24 of Outer Channel 13 and protrusions 46 and 38 of Inner Channel 14.

Angled Side Surfaces 73 are clamped by Angled Side Surfaces 30 of Upper Deck Board Recesses 29 in Outer Channel 13, Angled Side Surfaces 23 of Lower Deck Board Recesses 22 in Outer Channel 13, Angled Side Surfaces 45 of Upper Deck Board Recesses 44 in Inner Channel 14 and Angled Side Surfaces 23 of Lower Deck Board Recesses 36 in Inner Channel 14.

Surfaces 74 are removed areas to reduce weight and cost.

Stiffening Rib 75 increases strength and rigidity with minimal additional cost and weight.

Referring to FIG. 55-58, alternate design extruded Deck Board can be manufactured from polymer, extruded composite or extruded metal.

Top Surface 76 provides support for packages loaded on Modular Pallet.

Top Surface 76 can be inverted and Deck Board located in Lower Deck Board Recesses 22 of Outer Channel 13 and Lower Deck Board Recesses 36 of Inner Channel 14 to provide support on grade.

Angled Side Surfaces 78 are clamped by Angled Side Surfaces 30 of Upper Deck Board Recesses 29 in Outer Channel 13, Angled Side Surfaces 23 of Lower Deck Board Recesses 22 in Outer Channel 13, Angled Side Surfaces 45 of Upper Deck Board Recesses 44 in Inner Channel 14 and Angled Side Surfaces 23 of Lower Deck Board Recesses 36 in Inner Channel 14.

Referring to FIG. 59-62, Metal Deck Board can be manufactured from light gauge metal. The preferred embodiment is light gauge steel, laser cut or stamped and formed.

Top Surface 79 provides support for packages loaded on Modular Pallet.

Top Surface 76 can be inverted and Deck Board located in Lower Deck Board Recesses 22 of Outer Channel 13 and Lower Deck Board Recesses 36 of Inner Channel 14 to provide support on grade.

Angled Side Surfaces 80 are clamped by Angled Side Surfaces 30 of Upper Deck Board Recesses 29 in Outer Channel 13, Angled Side Surfaces 23 of Lower Deck Board Recesses 22 in Outer Channel 13, Angled Side Surfaces 45 of Upper Deck Board Recesses 44 in Inner Channel 14 and Angled Side Surfaces 23 of Lower Deck Board Recesses 36 in Inner Channel 14.

Slot 82 provides location for Protrusion 31 on Outer Channel 13 and Protrusion 46 on Inner Channel 14.

Slot 81 provides location for Protrusion 24 on Outer Channel 13 and Protrusion 38 on Inner Channel 14.

Figure 63:
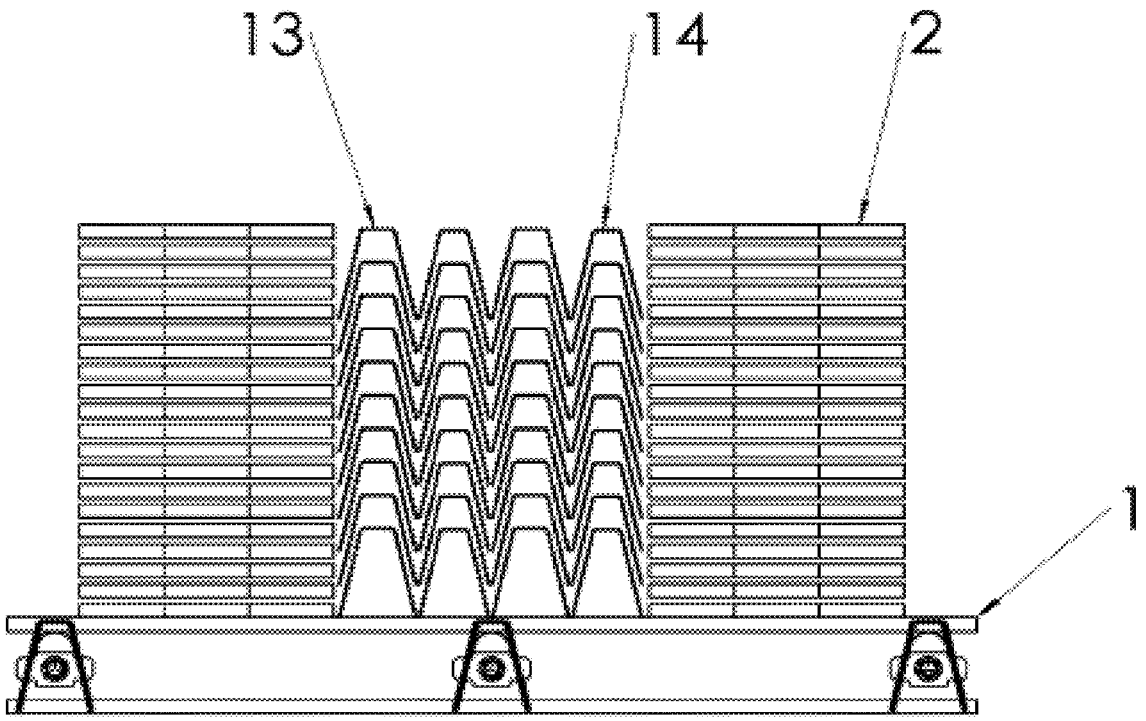
FIG. 63 depicts (1) Modular Pallet Assembly with stacked and nested Inner and Outer Stringer Channels and stacked Wood Deck Boards comprising components for (40) Pallet Assemblies

Referring to FIG. 63, this depicts the storage of Outer Channels 13, Inner Channels 14 and Wood Deck Boards 2 required to assemble (40) Modular Pallet Assemblies. Not shown are smaller components Bolt 15, Bolt Plate 16, Nut Plate 18, Captive Nut 17 and Spring Button Assembly 19.

Figure 64:
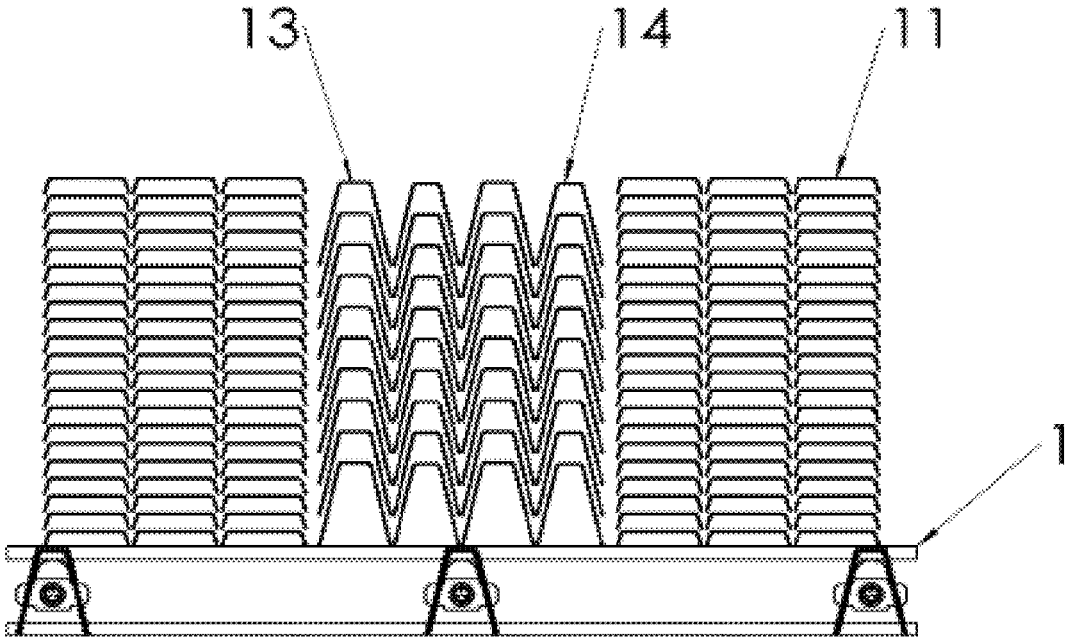
FIG. 64 depicts (1) Modular Pallet Assembly with stacked and nested Inner and Outer Stringer Channels and stacked and nested formed Metal Deck Boards comprising components for (40) Pallet Assemblies

Referring to FIG. 64, this depicts the storage of Outer Channels 13, Inner Channels 14 and Metal Deck Boards 4 required to assemble (40) Modular Pallet Assemblies. Not shown are smaller components Bolt 15, Bolt Plate 16, Nut Plate 18, Captive Nut 17 and Spring Button Assembly 19.

Referring to FIGS. 22, 25 and 26, opposing translation of Outer Channel 13 and Inner Channel 14 and resulting clamping force on Deck Boards is caused by clockwise rotation of Bolt 15, which screws into Captive Nut 17. Face of Bolt 15 applies force to Bolt Plate 16 which applies force to slot 27 in Outer Channel 13. Simultaneously, Captive Nut 17 applies an equal and opposite force to Nut Plate 18, which applies force to slot 40 in Inner Channel 14.

The magnitude of clamping force is proportional to the torque applied to Bolt 15. Using an easily attainable 50 ft.-lbs. of torque applied to the preferred embodiment of a Grade 5½-13 bolt results in a clamping force in the range of 5,000-10,000 lbs. per Stringer Assembly.

Dividing this clamping force by the number of contact points on Deck Boards results in forces exceeding what properly installed nails can provide. Thus, the clamping force provided by the Stringer Assembly provides superior security of Deck Boards than traditional nails can provide.

As discussed earlier, eliminating nails eliminates the primary source of Deck Board splitting. Further, any pre-existing splits in Deck Boards should be mitigated as Deck Boards are compressed by clamping forces.

Disassembly of the Modular Pallet System can be easily achieved with no tools.

Counterclockwise rotation of Bolt 15 translates Outer Channel 13 in relation to Inner Channel 14 until Spring Button Assembly 19 contacts end of slot 33 in Inner Channel 14. In this configuration, Deck Boards can be easily removed.

To disassemble Stringer Assemblies, continued counterclockwise rotation allows removal of Bolt 15. Captive Nut 17 can be removed from Nut Plate 18. Removal of Bolt Plate 16, Nut Plate 18 and Spring Button Assembly 19 complete disassembly process.

Assembly is achieved by reversing disassembly process.

I claim:

1. A Modular Pallet System for the movement of goods comprising:

a plurality of deck boards;

a plurality of stringer assemblies;

wherein each of the stringer assemblies is constructed from a plurality of parallel elongate members, each elongate member fitted with recesses to accept deck boards; and wherein plurality of elongate members are configured to translate in relation to each other to apply clamping forces to the deck boards for the purpose of locating and securing the deck boards to provide bracing, structural integrity and load capacity, wherein the translation is achieved by actuation of screw, cam, wedge, or other mechanical means.

2. The system of claim 1, wherein the number and location of stringer assemblies can be varied to vary size and load capacity.

3. The system of claim 1, wherein the deck boards can be fashioned from wood, plastic or metal and are interchangeable.

4. The system of claim 1, wherein the pallet assembly can be disassembled and reassembled for repair, reconfiguration or refurbishment and constituent components packaged for storage and shipping.

5. A stringer assembly for a modular pallet system constructed from a plurality of elongate members;

wherein elongate members are fitted with recesses to accept deck boards; and wherein the plurality of elongate members are configured to translate in relation to each other to apply clamping forces to the deck boards for the purpose of securement of the deck boards and to provide structural integrity and load capacity, wherein the translation is achieved by actuation of screw, cam, wedge, or other mechanical means.

6. The assembly of claim 5 wherein the elongate members are fashioned from wood, plastic or metal; and wherein the elongate members can be formed from tubular members, planar shapes, channels, tapered channels, hat sections, angles or other common structural shapes.

7. The assembly of claim 6, wherein the elongate members are fitted with slots to accept forklift forks.

8. The assembly of claim 5, wherein extents of translation of the elongate members are limited by slots to provide an open position from installation of deck boards and a maximum translation position to prevent over-clamping or crushing of deck boards.

9. The assembly of claim 5 wherein the elongate members are formed from steel channels with sloped side surfaces to facilitate stacking of nested elongate members.

10. The assembly of claim 9, wherein the recesses in the elongate members have non-vertical sloping surfaces configured to receive mating non-vertical sloping surfaces of the deck boards.

11. The assembly of claim 9, wherein the recesses in the elongate members are configured with shaped protrusions, serrations, or texture to engage and secure the deck boards.

12. The system of claim 9, wherein the deck boards are fashioned from wood, plastic or metal with constant section along a length and are fashioned with continuous or intermittent grooves or slots along the length to engage the non-vertical sloping surfaces of the elongate members.

13. The assembly of claim 5 wherein the elongate members are configured with openings to accept deck boards.

14. The system of claim 1, wherein the deck boards have sloped side surfaces to facilitate securement to the stringer assembly.

15. The system of claim 1, wherein the deck boards are fashioned from wood, plastic, or metal with a constant section along a length, and wherein the deck boards have non-vertical sloping surfaces to facilitate nesting of deck boards.

* * * * *